US012465843B2

(12) United States Patent
Curley

(10) Patent No.: US 12,465,843 B2
(45) Date of Patent: Nov. 11, 2025

(54) HIGH SPEED HAND-FORMING SHUFFLER

(71) Applicant: Charles M Curley, Cortland, NY (US)

(72) Inventor: Charles M Curley, Cortland, NY (US)

( * ) Notice: Subject to any disclaimer, the term of this patent is extended or adjusted under 35 U.S.C. 154(b) by 14 days.

(21) Appl. No.: 18/827,765

(22) Filed: Sep. 8, 2024

(65) Prior Publication Data

US 2025/0050200 A1 Feb. 13, 2025

Related U.S. Application Data

(63) Continuation-in-part of application No. 18/446,139, filed on Aug. 8, 2023.

(51) Int. Cl.
*A63F 1/12* (2006.01)

(52) U.S. Cl.
CPC ..... *A63F 1/12* (2013.01)

(58) Field of Classification Search
CPC ..... A63F 1/12; A63F 1/14
See application file for complete search history.

(56) References Cited

U.S. PATENT DOCUMENTS

| | | | |
|---|---|---|---|
| 1,885,276 | A | 11/1932 | Mckay |
| 2,755,090 | A | 7/1956 | Aldrich |
| 2,815,214 | A | 12/1957 | Hall |
| 3,260,520 | A | 7/1966 | Sugden |
| 3,771,783 | A | 11/1973 | McInerny |
| 3,897,954 | A | 8/1975 | Erickson |
| 4,513,969 | A | 4/1985 | Samsel |
| 4,586,712 | A | 5/1986 | Lorber |
| 4,770,421 | A | 9/1988 | Hoffman |
| 4,969,648 | A | 11/1990 | Hollinger |
| 5,000,453 | A | 3/1991 | Stevens |
| 5,445,377 | A | 8/1995 | Steinbach |
| 5,718,427 | A | 2/1998 | Cranford |
| 5,944,310 | A | 8/1999 | Johnson |
| 5,989,122 | A | 11/1999 | Roblejo |
| 6,149,154 | A | 11/2000 | Grauzer |
| 6,250,632 | B1 | 6/2001 | Albrecht |
| 6,254,096 | B1 | 7/2001 | Grauzer |
| 6,267,248 | B1 | 7/2001 | Johnson |
| 6,651,981 | B2 | 11/2003 | Grauzer |
| 6,651,982 | B2 | 11/2003 | Grauzer |
| 6,655,684 | B2 | 12/2003 | Grauzer |
| 6,659,460 | B2 | 12/2003 | Blaha |
| 6,676,127 | B2 | 1/2004 | Johnson |

(Continued)

*Primary Examiner* — Michael D Dennis
(74) *Attorney, Agent, or Firm* — Chris Tanner; BlueCollarIP.com

(57) ABSTRACT

The invention herein describes a card handling apparatus used for automatically creating play-ready hands for use in casino poker games whereupon the apparatus may be programmed to accommodate a number of different game variations, and a variable number of players. The apparatus verifies the integrity of each deck before discharging the play-ready hands to a first discharge portal. Decks that do not meet verification criteria are isolated and moved to a second discharge portal. Non-faulty decks are moved to a metering station where they are metered to a card output tray at high speed while forming the play-ready substacks. Two decks may be shuffled, verified and queued within the device before commencing a game, or a second deck may undergo shuffling while play-ready hands from a first deck are being metered to the output tray.

19 Claims, 22 Drawing Sheets

(56) References Cited

U.S. PATENT DOCUMENTS

| | | | | |
|---|---|---|---|---|
| 6,889,979 | B2 | 5/2005 | Blaha | |
| 7,036,818 | B2 | 5/2006 | Grauzer | |
| 7,059,602 | B2 | 6/2006 | Grauzer | |
| 7,073,791 | B2 | 7/2006 | Grauzer | |
| 7,261,294 | B2 | 8/2007 | Grauzer | |
| 7,338,044 | B2 | 3/2008 | Grauzer | |
| 7,367,561 | B2 | 5/2008 | Blaha | |
| 7,500,672 | B2 | 3/2009 | Ho | |
| 7,677,565 | B2 | 3/2010 | Grauzer | |
| 7,753,373 | B2 | 7/2010 | Grauzer | |
| 7,753,374 | B2 | 7/2010 | Ho | |
| 7,764,836 | B2 | 7/2010 | Downs | |
| 7,766,332 | B2 | 8/2010 | Grauzer | |
| 7,766,333 | B1 | 8/2010 | Stardust | |
| 7,900,923 | B2 | 3/2011 | Toyama | |
| 7,900,924 | B2 | 3/2011 | Ho | |
| 8,011,661 | B2 | 9/2011 | Stasson | |
| 8,038,521 | B2 | 10/2011 | Grauzer | |
| 8,267,404 | B2 | 9/2012 | Grauzer | |
| 8,342,525 | B2 | 1/2013 | Scheper | |
| 8,342,526 | B1 | 1/2013 | Sampson | |
| 8,353,513 | B2 | 1/2013 | Swanson | |
| 8,366,109 | B2 | 2/2013 | Soltys | |
| 8,419,016 | B2 | 4/2013 | Yoseloff | |
| 8,419,521 | B2 | 4/2013 | Grauzer | |
| 8,444,147 | B2 | 5/2013 | Grauzer | |
| 8,544,848 | B2 | 10/2013 | Blaha | |
| 8,556,263 | B2 | 10/2013 | Grauzer | |
| 8,590,896 | B2 | 11/2013 | Krenn | |
| 8,651,486 | B2 | 2/2014 | Grauzer | |
| 8,702,100 | B2 | 4/2014 | Snow | |
| 8,807,348 | B2 | 8/2014 | Johnson | |
| 8,814,164 | B2 | 8/2014 | Baker | |
| 8,931,779 | B2 | 1/2015 | Grauzer | |
| 9,126,103 | B2 | 9/2015 | Krenn | |
| 9,457,262 | B2 | 10/2016 | Shigeta | |
| 9,474,957 | B2 | 10/2016 | Haushalter | |
| 9,504,905 | B2 | 11/2016 | Kelly | |
| 9,623,317 | B2 | 4/2017 | Scheper | |
| 9,717,979 | B2 | 8/2017 | Grauzer | |
| 9,922,502 | B2 | 3/2018 | Grauzer | |
| 10,226,686 | B2 | 3/2019 | Scheper | |
| 10,864,431 | B2 | 12/2020 | Stasson | |
| 11,338,194 | B2 | 5/2022 | Helgesen | |
| 11,376,489 | B2 | 7/2022 | Scheper | |
| 11,426,649 | B2 | 8/2022 | Rynda | |
| 2005/0012269 | A1* | 1/2005 | Grauzer | A63F 1/12 273/149 R |
| 2007/0102879 | A1* | 5/2007 | Stasson | G07F 17/32 273/149 R |
| 2021/0072018 | A1* | 3/2021 | Krenn | A63F 1/02 |
| 2024/0009547 | A1* | 1/2024 | Oeding | A63F 1/12 |

* cited by examiner (1997)

(1997)

(2003)

(2003)

HIGH SPEED HAND-FORMING SHUFFLER

FIELD OF INVENTION

The present invention is related to the field of casino grade automatic card shuffling machines, which are used by casinos to speed up the rate of play of dealer-hosted card games. More particularly, the invention relates to shuffling machines which randomize the rank and suit of cards within a single deck of playing cards in order to form play-ready "hands" for use in various types of poker games. These shuffler types are called "hand-forming" shufflers in the art because they disgorge groups of play-ready cards to a discharge portal, whereupon a casino dealer issues one shuffled hand to each player at the initiation of a poker game. The groups of play-ready cards are herein referred to as "substacks".

BACKGROUND

Stud poker games such as Let it Ride®, Three-Card Poker®, or Caribbean Stud® are major attractions in casino poker rooms because they are relatively easy to play and allow wagering to various degrees of risk. A single deck of 52 playing cards is used in these games, which must be periodically shuffled to effect randomness of the rank and suit of the individual cards within the deck. Each poker game is initiated by delivering a shuffled (randomized) hand of playing cards to each game participant. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

Conventional "hand-forming" shufflers randomize card decks and sort them into shuffled substacks within compartments which reside within the apparatus. Upon dealer request, a substack is delivered from one compartment to a discharge portal where a dealer may issue that hand to a player. The hand-forming shufflers are programmable such that the number of cards in each substack may be adjusted for individual card games, and for the number of players. For example, various forms of five-card stud poker will be initiated with hands of 5 cards, while games such as Three-Card Poker® are played with hands of only three cards.

FIG. 1 illustrates an early "hand-forming" playing card shuffler that was described in a 1932 patent granted to R. C. Mckay and issued as U.S. Pat. No. 1,885,276 (Mckay '276). Groups of individual playing cards are accumulated into substacks in four compartments which are configured radially in a rotating carrier. FIG. 1 is reproduced from the Mckay '276 patent which explains that individual cards are separated from an unshuffled deck and randomly accumulated into four compartments. The substacks of cards are retained in each compartmental nest by gravity, and the substacks must be removed from their nests by displacing the card carrier so that the cards may be removed in the same direction from which they were inserted.

Referring to FIG. 1, the rotational housing which carries the four compartments is called the "receiver" 1024, which possesses four compartments 1025 thru 1028 for accumulating substacks of randomly selected cards. The receiver 1024 rotates about pivot 1032 to one of four randomly chosen radial positions. A deck of cards is placed into the magazine 1001 which utilizes rubber tired wheels 1003 to strip individual cards from the bottom of the stack and move them through a slotted opening 1050 under the power of a hand crank. An innovative random selection mechanism using small balls of four sizes is used to randomly position the receiver 1024 to one of four radial positions for collecting the individual cards into compartments 1025 thru 1028.

Mckay '276 appears to have pioneered the concept of "shuffling" cards by distributing individual cards randomly into a myriad of compartments. Indeed, the 1932 patent is entitled AUTOMATIC CARD SHUFFLER AND DEALER, and teaches an innovative randomizing configuration which was implemented without the aid of motors or microcontrollers.

A later shuffler patent is well known in the art as the "Lorber Design" and was taught by U.S. Pat. No. 4,586,712 (Lorber '712), which was granted in 1986. This classic configuration (shown in FIG. 2) is based upon unloading cards from an unshuffled deck into the individual slots of a carousel, randomly rotating the carousel, and then pushing individual cards from the carousel slots and into a shoe. Each slot in the Lorber '712 carousel holds one card.

As shown in the upper section of FIG. 2, an unshuffled card stack 2053 is deposited on edge into container 2052 of the automatic shuffling apparatus 2050. Individual cards are vertically stripped from the stack and moved downward from the left end of container 2052 and into a carousel 2062 by driven roll 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within the carousel 2062. Individual cards are extracted from the randomly rotated carousel 2062 at the station shown in the bottom left section of the figure by the action of an "ejecting device" 2066. The device 2066 is a mechanism that pushes the individual cards out of their storage slots. Driven rolls 2054 and 2055 move the individual cards into a newly created stack within the space 2068. The stack of cards within discharge portal 2068 has thus been arranged randomly (shuffled).

Rather than arranging the card storage compartments within a circular carousel, other early shufflers utilized compartments configured in a vertical stack. 1988 U.S. Pat. No. 4,770,421 to Lionel Hoffman (Hoffman '421) teaches a stack of "mixing pockets". Referring to FIG. 3A, which is reproduced and annotated from that patent, the six mixing pockets 934A through 934F are arranged in a linear stack. The Hoffman '421 specification explains that cards are individually inserted into a randomly chosen compartment within the stack of mixing pockets, accumulated, and then extracted in groups from the mixing pockets in a random order. The specification explains;

> According to a more particular form of the invention, a card shuffler is provided comprising a plurality of mixing pockets for holding cards, and card holding and distribution means for holding a stack of cards and for distributing and transferring one card at a time in sequence to said mixing pockets in accordance with a first distribution schedule. (Hoffman '421 1:61-67)

The compartment shuffler art has since generally evolved into myriads of disclosures that are characterized by their storage compartment configurations. A large group of more recent shuffler disclosures utilize linear stacks and elevators, and another large group of more recent disclosures utilize circularly-arranged storage compartments exemplified by drums and carousels. Both types of storage compartment configurations utilize "pusher mechanisms" to extract the cards from their storage compartments. The terms "shuttle" and "shuttling" used herein are defined as the excursions of the carousel or elevators in compartment shufflers that are utilized to align the compartments with those "pusher mechanisms".

Another well known "hand-forming" shuffler is taught by U.S. Pat. No. 6,659,460 which was granted in 2003 to Ernst Blaha (Blaha '460), as shown in FIG. 3B. Blaha '460 also incorporates a carousel configuration which is similar to the Lorber design, but Blaha '460 differs from its predecessor by configuring the carousel slots to accumulate multiple cards. In this way, Blaha is used as a hand forming shuffler by accumulating the proper number of cards within each compartment which can later be disgorged as play-ready substacks (hands).

Referring to FIG. 3B, unshuffled cards 313 residing in an unshuffled card station 310 (upper left) are transported by feed rolls 314, 315, 318 and 319 into compartments 369 of the "rotatably held drum" 302. The rolls 318 and 319 are unable to fully insert the cards into the compartments, thus requiring a first pusher 316 which is driven by a motor 323 through eccentric link 322. The pusher 316 pushes each card through the final small movement into the compartments 369 of the drum 302. The drum is rotated by motor 308 to random loading positions as commanded by a microprocessor such that each compartment may accumulate a series of randomly selected cards.

The drum compartments are unloaded to a second station 342 by a second pusher linkage 335 and 337 which is actuated by a motor-driven eccentric 338. After each card 382 is pushed sufficiently into the friction rolls 340 and 345, those rolls move the cards to the "card storage means" 342, as driven by motor 341. Blaha '460 uses two motors to insert each card into the drum, and another two motors to extract the substacks. Two of the motors operate "pusher mechanisms" which are required to push the substacks into and out of each compartment.

The response time of the Blaha '460 shuffler is limited by its own carousel configuration. It is clear that the majority of time required by the shuffling cycle is utilized to intermittently rotate the carousel amongst the randomly chosen storage positions. The time used up by these intermittent rotation cycles certainly dominates the lesser cycle time portions required to insert and extract the cards from its radial compartments.

Another rotational shuffler is taught by U.S. Pat. No. 7,500,672 (Ho '672) which uses a "shuffling wheel" which appears to be similar to the classic Lorber '712 carousel. FIG. 4 illustrates an isometric view of the disclosure which was granted in 2008 and whose inventor is listed as Cai-Shiang Ho. Unshuffled cards are moved from a "card input device" 6221 into the slots of a "shuffling wheel" 6100 by a series of feed rolls. Ho '672 illustrates yet another exemplary shuffler design which utilizes "pusher mechanisms" for insertion and extraction of cards from its radially arranged compartments.

FIG. 5 shows a side view from Ho '672 which illustrates the shuffling wheel 6100 and card input device 6221. The card substacks are clamped into the card slots 6012 by coil springs 6121 so as to prevent outward propulsion by centrifugal force. Since the cards are clamped into the wheel slots, motorized "pusher" mechanisms must be used to overcome the clamping forces while inserting and extracting the cards from the wheel slots.

A lever 6024 is shown mounted to the shaft of motor 6025 in FIG. 5 adjacent to the entry of the card feeding roll 6011 at the entry to the shuffling wheel 6100. Ho '672 describes the lever 6024 in the passage which is paraphrased below, where the label numerals from the original reference are modified to reflect the equivalent labels used herein.

> the lever (6024) is mounted in the card-input device (6221) adjacent to the shuffling device (6100) and is connected to and is rotated by a control motor (6025). The control motor (6025) rotates the lever (6024) to push a card conveyed toward an end of the inlet passage. Therefore, the card is completely pushed into the shuffling device (6100). ('672 4:26-32)

Similarly, the arm 6180 and motor 6183 shown in FIG. 5 are used to push the substacks out of the slots 6012. The '672 specification explains;

> The arm (6185) aligns with one of the card slots (6012) of the shuffling wheel (6100) and discharges the card stored in the corresponding card slot (6012). ('672 5:20-23)

U.S. Pat. No. 6,149,154 was granted to Attila Grauzer et al in 2000 (Grauzer '154) and describes another "hand-forming" shuffler where the carousel compartments are unwound into the form of a linear elevator. The elevator consists of stacked card accumulation compartments which are moved linearly rather than rotationally. FIG. 6 shows an illustration reproduced from the '154 patent showing the side view of the device, including the "hand receiving platform" 836, the "card moving mechanism" 830, the "rack assembly" 828, and the card receiver 826 "for receiving a group of cards for being formed into hands". Operation is understandingly similar to the carousel devices. Cards are inserted into randomly chosen slots of the elevator at one station, and thereafter pushed from randomly chosen slots at another station after being aligned with a "pusher".

Referring to FIG. 6, Grauzer '154 teaches an elevator with nine compartments called a "rack assembly" which traverses up and down in direction of arrow 884. Unshuffled card decks are placed into the unshuffled card receiver 826 against the surface 870 of a moveable block 868, and individually propelled in direction of arrow 882 by motorized rolls 850, 862 and 864 into the compartments of the rack assembly 828 at the loading station 830. An elevator motor 842 and timing belt 840 move the rack assembly upwards and downwards to align randomly chosen compartments with arrow 882. Thereafter, each card is inserted into a randomly chosen compartment and temporarily accumulated with others. A microcontroller counts the number of cards inserted into each randomly chosen compartment. When a given compartment reaches the capacity of cards required for a hand, no more cards are entered into that compartment, and the compartment is considered ready for discharge.

When enough compartments are filled to the hand capacity needed for the number of players, the shuffler is then ready to disgorge its accumulated substacks (hands). A pusher mechanism 890 is located at a lower station and used to push the substacks out of the compartments in the direction of arrow 886 and into the "hand receiving platform" 836. In comparison to the carousel shuffler designs, Grauzer '154 teaches that only nine (9) compartments are required for proper randomization in a hand-forming shuffler.

In the Grauzer '154 configuration, the substacks are retained within each elevator compartment by gravity. Thus, a motorized "pusher mechanism" is needed for removing the substacks from the elevator compartments to the hand receiving platform 836. FIG. 7 is a reproduction from another figure of the Grauzer '154 patent that explains the card removal pusher mechanism in more detail. The elevator positions the compartment requiring extraction at a level occupied by a "pusher' mechanism as aligned with arrow 886. The substacks are thereafter pushed out of the compartment 892 allowing the substack to fall by gravity into the hand receiving platform 836. Grauzer '154 describes the pusher 890 as a "rack". The passage below paraphrases a section of the Grauzer disclosure where the label numerals are altered to the equivalent labels used herein.

> The pusher 890 includes a substantially rigid pusher arm in the form of a rack having a plurality of linearly arranged apertures along its length. The arm 890 operably engages the teeth of a pinion gear 896 driven by an unloading motor 898, which is in turn controlled by the microprocessor. At its leading or card contacting end, the pusher arm 890 includes a blunt, enlarged card-contacting end portion. ('154 12:56-67)

Grauzer '154 describes the well-known commercialized "hand forming" shuffler manufactured by ShuffleMaster, called the ACE Shuffler®. The elevator is referred to as a "rack assembly" in the disclosure and consists of eight "hand forming" compartments and a ninth oversized compartment for accumulating the unused cards which remain after all of the required hands have been formed. The oversized compartment is located centrally within the elevator and indicated by label 894 in FIG. 7. The disclosure explains that eight compartments are sufficient for statistical randomization of a deck (52 cards) in the following paraphrased passage.

> Preferably, the rack assembly 828 has nine compartments. Seven of the nine compartments are for forming player hands, one compartment forms dealer hands and the last compartment 894 is for accepting unused or discard cards. It should be understood that the device the present invention is not limited to rack assembly with seven compartments. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. ('154 8:66-67, 9:1-10)

The oversized compartment 894 shown in FIG. 7 is required to collect the unused cards from the unshuffled card receiver. The unused cards must be temporarily stored in the rack assembly because there is no direct path from the unshuffled card receiver to the hand receiving platform. That problem is resolved by the card handling device being disclosed herein, which eliminates the need for a dedicated card storage compartment for storing unutilized cards.

A similar prior art disclosure by Grauzer et al is U.S. Pat. No. 6,254,096 (Grauzer '096) which is shown in FIG. 8. This disclosure describes a similar stacked compartment shuffler as Grauzer '154, but with addition of more compartments. Grauzer '096 explains nineteen (19) compartments while Grauzer '154 explained nine (9) compartments. The figures in Grauzer '096 better illustrate the extents of the pusher excursion which is used to extract the cards from each of the stacked compartments. FIG. 8 herein is reproduced and annotated from a figure in Grauzer '096. Balloon A indicates the tip of the pusher prior to the substack extraction cycle while Balloon B indicates the position of the pusher tip at the end of each compartment discharge cycle. During the return stroke, the tip of the pusher moves from Balloon B position back to the Balloon A position. If the reader relies upon the proportionality of the figure, then the pusher tip moves about three card widths (3×2.5") during the forward stroke and another three card widths (3×2.5") during the return stroke, or approximately fifteen (15) inches during each compartment discharge cycle.

The Blaha '460 shuffler and the Grauzer '154 shuffler are exemplary hand forming shufflers in that their operation consists of two characteristic cycles that must be performed in serial fashion. The first cycle is the "shuffling" cycle whereupon individual cards are moved from the unshuffled stack individually and sorted into randomly chosen storage compartments. Once the required number of compartments have accumulated a threshold number of cards, the substacks in each compartment are said to have been randomized (shuffled).

The second cycle is the disgorgement cycle whereupon the contents of the storage compartments must each be aligned with a pusher mechanism to be disgorged from the device. This cycle may only be initiated after the "shuffling" cycle has completed. Prior to the start of the shuffling cycle, the machine must "know" at least two parameters; how many cards are needed in each hand for the type of poker game selected and how many player hands are needed. With those two criteria established, the microcontroller can insert the proper number of cards into each compartment and fill the required number of compartments. The response time of historical "hand-forming" shufflers is handicapped by the requirement that these two cycles must be completed serially, and only initiated after the two parameters have been resolved. One objective of the card handling device being described herein is to remove the reliance of the disgorgement cycle upon the shuffling cycle in order to improve shuffler response.

A second objective of the card handling device being described herein is to eliminate the pusher mechanisms and the associated cycle times needed to extend and retract them. As shown in FIG. 8, the pusher advance stroke and its return stroke steal significant amounts of time from the disgorgement cycle, thus limiting the shuffler's responsiveness. The card handling device being described herein eliminates both the insertion cycle time and the withdrawal cycle time required for a pusher mechanism to disgorge each and every substack.

A third objective of the shuffler being described herein is to eliminate the relatively long shuttling excursions amongst storage compartments during the disgorgement cycle. Elimination of those shuttling excursions significantly reduces the response time between disgorgement of each substack (hand).

A fourth objective of the card handling device being described herein is the elimination of the elongated purging cycles associated with the conventional hand-forming compartment shufflers at the end of each game. After the hands have been distributed to all players, there are various amounts of cards left in each of the compartments of a hand-forming compartment shuffler and in the unshuffled card portal. For example, for certain 7-card stud games such as "Rollover" or "Baseball", each hand consists of seven cards which are delivered to each player, and no additional cards are needed for that game. If there are five players, then thirty-five (35) cards will have been dealt, leaving seventeen (17) cards distributed in the compartments within the shuffler. Some of these residual cards will have been delivered to unfilled compartments and some will remain within the unshuffled card input station. Comparatively, a game of Three-Card Poker® with five players will only utilize eighteen (18) cards (five player hands and one dealer hand). In this latter case, the majority of cards (34) will remain unplayed and the dealer will need to purge the shuffler of these residual cards before starting a new game.

Within the purging cycle of conventional hand-forming devices, the microcontroller must shuttle each non-empty compartment to align with the pusher mechanism in order to unload the residual substacks that remain within the device. This is a time-consuming operation that delays the initiation of the next game. The device being described herein significantly reduces the time for the end-of-game purging cycle.

Reliability is a fifth objective of the high speed shuffler being described herein. Improved reliability is achieved by avoiding narrow slotted elevators and the jamming problems associated with those prior art designs that result from warped cards or bent cards by implementing a unique slot-less elevator.

The problem of narrow slots is disclosed within the disclosure of U.S. Pat. No. 11,338,194 (Helgesen '194) which is illustrated herein as FIG. 9. This patent discloses a more recent version of the vertical adaptation of the classic "Lorber Design" which utilizes a vertically oscillating comb with narrow card slots. As shown in FIG. 9, a card storage device 2100 possesses a vertically moving rack 2106 which comprises slotted assemblies 2102 and 2108 into which individual cards are inserted. Helgesen '194 explains that the card rack 2106 is configured to translate in the vertical direction along a linear path- and that the card storage device 2100 includes a motor 2110 configured to drive movement of the rack 2106 up and down in the vertical direction. Each card storage compartment has a slot 2104 in the first side bracket assembly 2102 and a corresponding and complementary slot 2104 in the second side bracket assembly 2108.

Helgesen '194 additionally discloses the intuitive observation that inserting bent or warped cards into narrow slots is problematic. US'194 states:

> "For example, one card in a deck may be bent or warped—causing the card to regularly fail to insert into its assigned upper or lower position during each shuffle." (Helgesen '194 col. 28; lines 63-65)

A simpler, and therefore more reliable randomizing mechanism was taught by prior art U.S. Pat. No. 5,683,085 (Johnson '085), which discloses a randomizing apparatus that is devoid of narrow-slotted combs, racks and compartments. As shown herein as FIG. 10, Johnson discloses a shuffling apparatus which possesses a "main shuffling chamber" 2200. A mechanical gripping member 2208 is attached to a mechanical gripping arm 2206 which can move vertically to random positions in chamber 2200 as commanded by a microprocessor. The arm 2206 grips and the lifts sub-stack 2202 at random positions which enables the insertion of an individual card 2210 from a secondary deck (unshuffled deck) 2212. The separating mechanism creates an opening between two sub-stacks 2202 and 2204, which allows the insertion of card 2210 from the secondary stack 2212 into the receiving stack at the opening. Johnson '085 simulates the well-known action that a dealer utilizes to manually insert a "cut card" into a deck as illustrated herein as FIG. 11.

Subsequent prior art U.S. Pat. No. 6,631,982 (Grauzer '982) also adopted the Johnson gripper. Whereas Johnson '085 has elevated the gripper to select a subset of cards, Grauzer '982 discloses that the gripper is held stationary, while the platform below is vertically lowered away from the gripper. The shuffler described in Grauzer '982 has a disadvantage because only one deck can be processed at a time. The elevator is used to support the final shuffled card deck in the output tray, thus preventing the use of the elevator for additional shuffling until the deck is removed by the dealer. U.S. Pat. No. 6,250,632 (Albrecht) discloses a shuffler with an elevator that suffers from the same problem. That shuffler cannot continue until a previously shuffled deck has been removed from the elevator at a "deck removal area" by the dealer.

The Johnson Method as shown in FIG. 10 illustrating Johnson '085 can be further understood from FIGS. 12A and 12B where a generic gripper arm is labeled 640. The gripper arm is mounted to an elevator which positions the arm at random vertical planes adjacent to the card stack 620 as shown in FIG. 12A. Referring to FIG. 12B, the gripper arm thereafter grasps a portion of the card stack 620U and lifts it upward, creating an opening to insert a playing card 626. The gripper arm thereafter lowers the upper stack onto the lower stack. The cycle is repeated until the desired number of cards are inserted randomly into the card stack 620.

Grauzer '982 also utilized a gripper to separate a card stack into two sub-stacks. Referring to FIGS. 13A and 13B, Grauzer '982 mounted the gripper arm 640 in a vertically stationary position and instead moved the card stack 620 with the elevator. After splitting the stack 620, the sub-stack 620L was lowered to create the opening for inserting card 626. After insertion, the lower substack 620L was thereafter raised to abut against the upper sub-stack 620U and the gripper was released. As compared to Johnson '085, Grauzer '982 lowered the lower sub-stack 620L rather than raising the upper sub-stack 620U as was taught by Johnson '085. Both prior art disclosures taught the advantages of avoiding narrow-slotted elevators.

The randomizing mechanism of the present invention is devoid of narrow slots (or otherwise slot-less), carousels, combs, racks, or ejector blades that are previously known to be vulnerable to jamming. A section of the card stack being randomized is raised by a gripper mechanism which creates a randomly chosen wedge-shaped opening for oblique insertion of a card from the unshuffled stack, raises an upper sub-stack, and thereafter lowers the upper sub-stack onto the newly inserted card. The large wedge-shaped opening is tolerant of the elevator position (also known as "position tolerant") during card insertion, thereby reducing the vulnerability to bent or warped cards, as is the problem with narrow-slotted mechanical shufflers.

Improved security is the sixth objective of the high speed shuffler being described herein. During the shuffling cycle each card is interrogated to insure the completeness of the deck prior to the initiating the card game. Decks containing unexpected cards, unreadable cards or unanticipated numbers of cards can be automatically isolated within the device without interrupting the disgorgement of the play-ready substacks.

The prior art explains that automatic shuffling machines have traditionally utilized verification measures to ensure the integrity of the deck by sensing and tracking the rank and suit of every card within the deck during the shuffling process. Numerous prior art references teach optical recognition devices that interrogate each card of a deck to verify that the deck is complete and does not contain extraneous cards. Some automatic shuffling machines verify that each and every card of each suit is included as required by the game being played, and that there exists no missing or extraneous cards resulting from machine malfunction or cheating.

For example, prior art U.S. Pat. No. 5,989,122 (Roblejo '122) as reproduced in FIG. 14 discloses an automatic shuffler that utilizes an optical card reader 2044 which reads rank and suit of individual cards before they are moved from an unshuffled input stack 2042 to the randomizing mechanism. The role of the optical recognition device is to verify the composition and completeness of a set of playing cards as cards are transported into the carousel compartments. Roblejo '122 explains that an apparatus 2040 has a control means 2041, an input means for receiving playing cards onto an input stack holder 2042, and buffer means (carousel) having a plurality of slots for temporarily holding cards, illustrated as a wheel 2043 having a plurality of slots 2048. The apparatus additionally possesses identification means for reading indicia, illustrated as bar code reader 2044 to determine identity of playing cards which can be specially marked with bar codes or other coded information. Alternatively, the cards can be unmarked.

"It is an object of this invention to provide an apparatus and method for receiving cards, either from new decks or after the cards have been played, to shuffle the cards in a randomized order, and simultaneously to verify the accuracy of the set or sets of cards in the deck or decks. (US'122 col. 2; lines 22-27)

"The means for reading indicia is preferably either a bar code reader, Video optical System, optical Scanner, reader of hologram information, or reader of magnetic indicia. (US'122, col. 3; lines 65-67)"

While Roblejo '122 explains multiple means to identify faulty cards during the shuffling process, it does not explain what is to be done with faulty cards and the resulting deck being processed once that deck has been identified as faulty. Other prior art disclosures also identify means for identifying faulty cards and explain only that the shuffling process is to be aborted and the deck is to be thereafter unloaded from the card handling device. Such an unloading process requires the serial extraction of each and every compartment of a compartment shuffler, thus imposing considerable delay for the players awaiting receipt of their playing hands. For example, Roblejo '122 teaches a carousel shuffler with 17 compartments. While counting each card as it enters the carousel, the device can only discern the proper number of cards in the deck after having loaded the compartments. Should the deck count indicate an unanticipated card shortage or surplus, then all 17 compartments must be serially unloaded while the players await their hands. The card handling device being described herein completely prevents such downtime by temporarily isolating faulty decks.

The card handling device described herein is intended to introduce a more compact and more responsive hand-forming shuffler than those which are referenced in the prior art, by achieving discernable cycle time and size reductions. The device described within this disclosure achieves these cycle time reductions by eliminating the need for multiple pusher mechanism strokes and eliminating the need to shuttle between compartments during the disgorgement cycle and the purging cycles. The resulting shuffler design requires less parts, is more compact and is more responsive than the referenced prior art while insuring that play ready hands have been issued from a properly verified deck.

The unique features and advantageous response of the card handling device herein will become better understood with reference to the descriptions, drawings and claims which are presented below.

DETAILED DESCRIPTION

Figure 1:
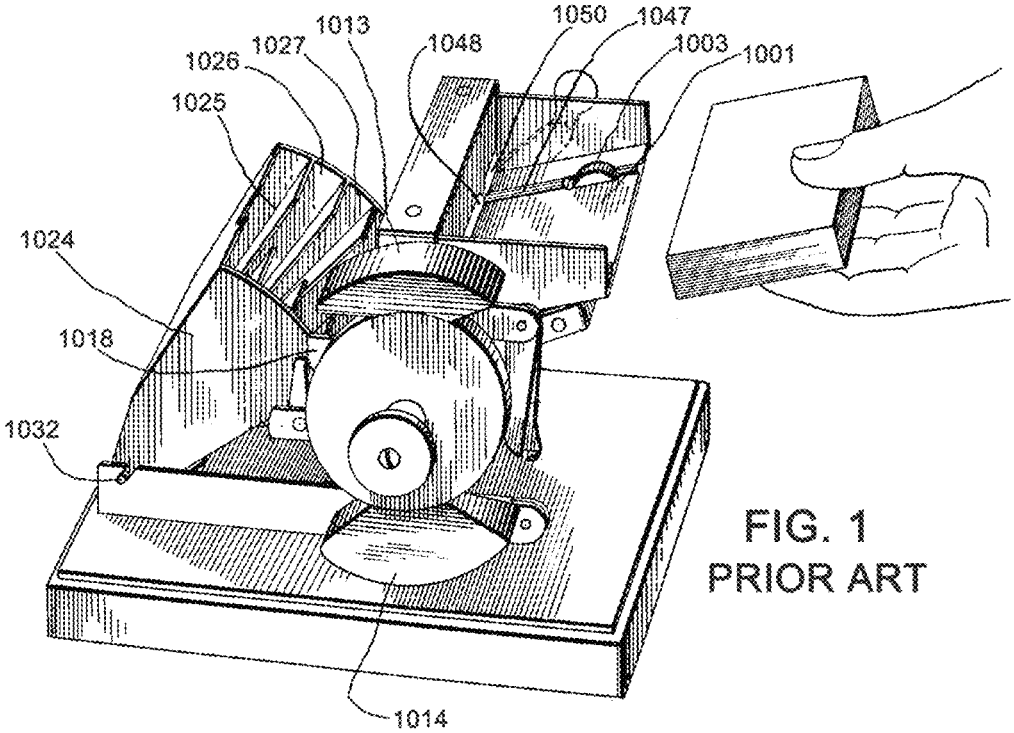
FIG. 1 PRIOR ART
FIG. 1 is a perspective view from an early (1932) hand-forming shuffler patent.

A casino-grade card handling apparatus for automatically shuffling, verifying and metering play-ready hands of playing cards is described for use in casino-hosted poker games. The shuffler can be programmed by an operator (dealer) for a number of different poker games and a number of players to quickly disgorge game-ready poker hands for each player. The play-ready hands are immediately disgorged after the dealer initiates the game with a "start" command.

For purposes of this explanation, the term "unshuffled deck" is defined as a deck of cards in need of being shuffled (randomized) and verified. The term "shuffled deck" is defined as a deck of cards that has been transformed from a "unshuffled deck" into a shuffled (randomized) deck. The term "verification sensor" is defined as a sensor that can interrogate a playing card for interpretation by a microcontroller. In the most rudimentary form, an interrogation sensor may merely detect the passing of a card along a card path such that the microcontroller can accumulate a card count. In more sophisticated forms, an interrogation sensor may take the form of a miniature camera that can photograph a passing card such that a microcontroller can understand its suit and rank as is known in the art. The definition of a "fault criteria" is the criteria used by a microcontroller to determine the suitability of a card or card deck after interpreting the "verification sensor". In its simplest form, a "fault criteria" may be the number of cards that have passed the "verification" sensor within a given operational span.

The definition of a "faulty deck" is a card deck that has failed to satisfy a "fault criteria", for example a card deck having a count of 51 cards when the microcontroller anticipated a count of 52 cards. Conversely, the microcontroller identifies a "verified deck" as a card deck that successfully avoided its "fault criteria" after interrogation by the "verification sensor". It is understood that the "fault criteria" utilized by the microcontroller in the card handing device being described herein can be adjusted according the sophistication of its "verification sensor", where the sophistication of that sensor is a designer's choice.

The term "play-ready substacks" as used herein is defined as a group of K cards which have been separated from a larger stack of shuffled cards to form a subset for a particular card game where K equals the number of shuffled cards needed to form a player's "hand" according to the rules of that particular game. For example, K=5 for games of five-card stud poker.

The term "metering station" as used herein is defined as a mechanism utilized to separate individual playing cards from a card stack one at a time at a constant rate in order to create a continuous flow. The term metering station comes from the copier and printer industry where the term is generically understood as the station that delivers sheets from the paper tray to the printing mechanism. At the time of this disclosure, a low cost $250 laser printer can typically print pages at the rate of 40 pages per minute. Sheets in these printers are metered to the printing station in fractions of a second. The term "metering station" thus connotates speed. The term "output tray" is defined as the tray which accumulates "play-ready substacks" (hands) from the metering station for delivery to a player in a card game.

Figure 15:
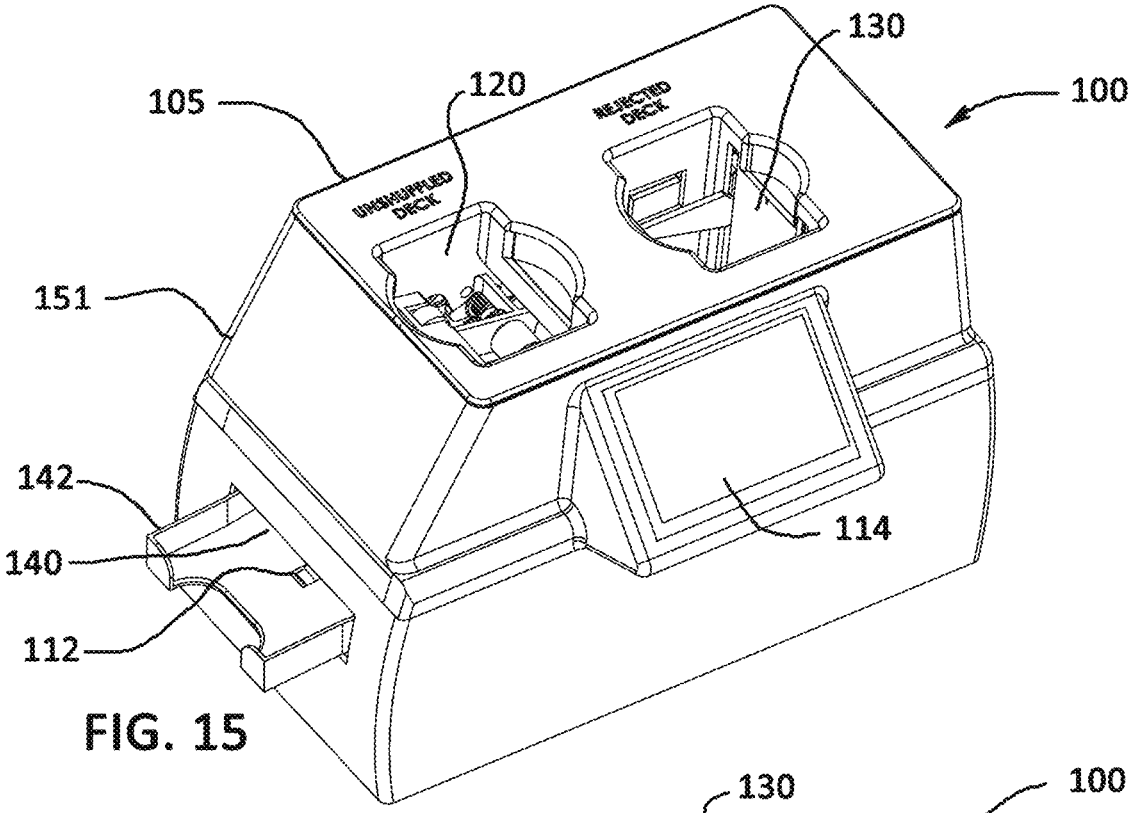
FIG. 15 is a perspective view of the preferred embodiment of the present invention as it would appear in a casino poker room.

FIG. 15 illustrates a preferred embodiment of the electromechanical shuffler apparatus disclosed herein as it would appear in the poker room of a casino. The device 100 comprises a recessed cavity 120 for receiving a new or spent (unshuffled) deck of playing cards from a poker game host (dealer), and a recessed cavity 130 for receiving a faulty deck of playing cards from the randomizing mechanism that resides below that cavity. An output portal 140 is utilized to automatically disgorge play-ready substacks (hands) from the apparatus 100. The output tray 142 includes a sensor 112 whose purpose is to detect the presence of cards. Casing 151 encloses the mechanism of the apparatus supports the touch screen panel 114.

The touch screen panel 114 is positioned conveniently for a casino dealer on the exterior of the housing. At least one microcontroller (not shown) controls the operation of the device, including operation of the control panel which is used to both input commands and to display conditions within the device, including fault conditions and progress conditions. Control panel 114 is a small 5-inch touchscreen that is used to program the shuffler for various games. For size reference, a 5-inch touchscreen is slightly smaller than the smaller touchscreens used in today's mobile phones. Prior to each game, the dealer will utilize the touch screen 114 to program the shuffler to produce the required number of cards in each hand as required by various forms of poker. Additionally, the dealer will program the shuffler to issue N hands, where N is the number hands needed for the game. The touchscreen will also indicate possible malfunctions and security issues to the dealer. For example, the microcontroller counts the number of cards processed in each deck and will issue a warning on the touch panel if that number is unexpected due to player or dealer cheating. When more sophisticated verification sensors are utilized, the touch screen will display error messages accordingly. For example, when optical recognition sensors are utilized, the touch screen might display "Shuffle Completed-Queen of Spades Not Detected".

The apparatus 100 may be placed upon a casino table surface or the apparatus 100 may reside along side on the edge of the table near the dealer within arm's reach, such that the dealer may easily insert and withdraw card decks from the recessed trays 120, 130 and withdraw play-ready hands form the portal 140.

The functional objective of the apparatus 100 is to prepare card decks for play by shuffling decks (randomizing) and interrogating those decks for irregularities such as missing cards or unreadable cards, and to thereafter disgorge verified play-ready hands to the discharge portal 140 upon demand. The apparatus 100 removes faulty decks from play and signals the host operator the reason for the ejection. The apparatus 100 additionally allows the host operator to queue up two decks prior to initiating any particular game.

Figure 16:
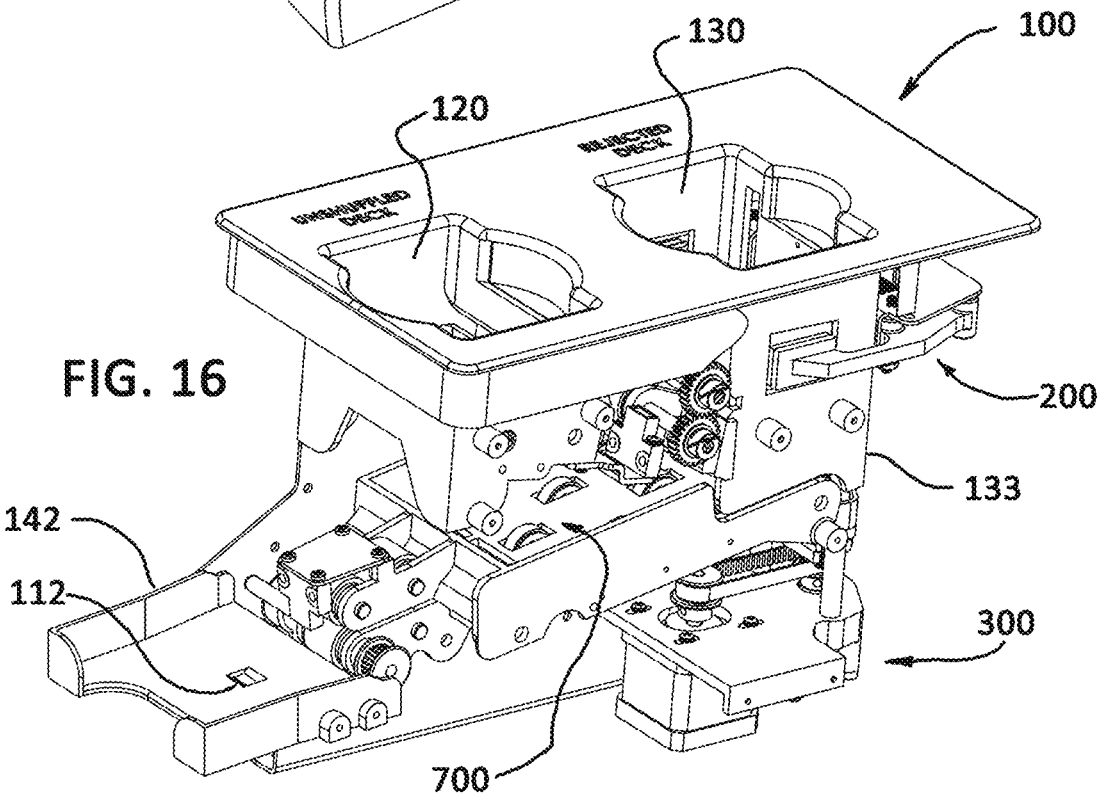
FIG. 16. is an isometric view of the apparatus herein showing the internal chambers and card paths with no cards present.

FIG. 16 shows an isometric view of the apparatus 100 with the casing removed. The various components are supported by side frames, and one side frame has been removed from the view to reveal the internal chambers. An elevator mechanism 300 is located directly below the faulty deck reject cavity 130, and a card metering assembly 700 is shown sloping away from a lower portion of a randomizer chamber housing 133. In general, unshuffled cards are deposited into the input portal 120 and thereafter passed individually into the randomizing chamber within housing 133 where they are randomized. Verified (nonfaulty decks) are then moved to a metering station 700 where they are metered into the output tray 142 in substacks comprising play-ready hands. Card decks found to be faulty after randomization are instead moved to the discharge portal 130. Although not shown, the discharge portal 130 may have a hinged cover (not shown) to prevent viewability of the cards contained within that cavity.

A microcontroller operates in concert with a "Real Time Clock" (RTC) and segments of memory to record the exact time of certain sensor-activated events including the rejection of faulty decks. RTC's are used to timestamp events in six timing parameters including year, month, day, hour, minutes and seconds. A commonly utilized RTC is for example model DS1307 made by Dallas Semiconductor Corporation. The RTC is used to timestamp the insertion of card decks into the input portal 120, the delivery of verified card decks to the card metering station 700, the delivery of play ready hands to the output tray 142, and the delivery of faulty card decks to the discharge portal 130. In the case of the faulty deck rejections, the microcontroller will additionally record a reason for rejection along with a timestamp. The casing 151 possesses a USB port (not shown) that may be used to download the timestamped data from memory of the apparatus 100. Alternatively, the apparatus 100 may be networked to a central computing device in the casino that can periodically or continually (in real time) download the timestamped data associated with processed card decks. The network connection may be used to monitor activity and performance characteristics of the apparatus from a remote location, as is known in the art.

Figure 17:
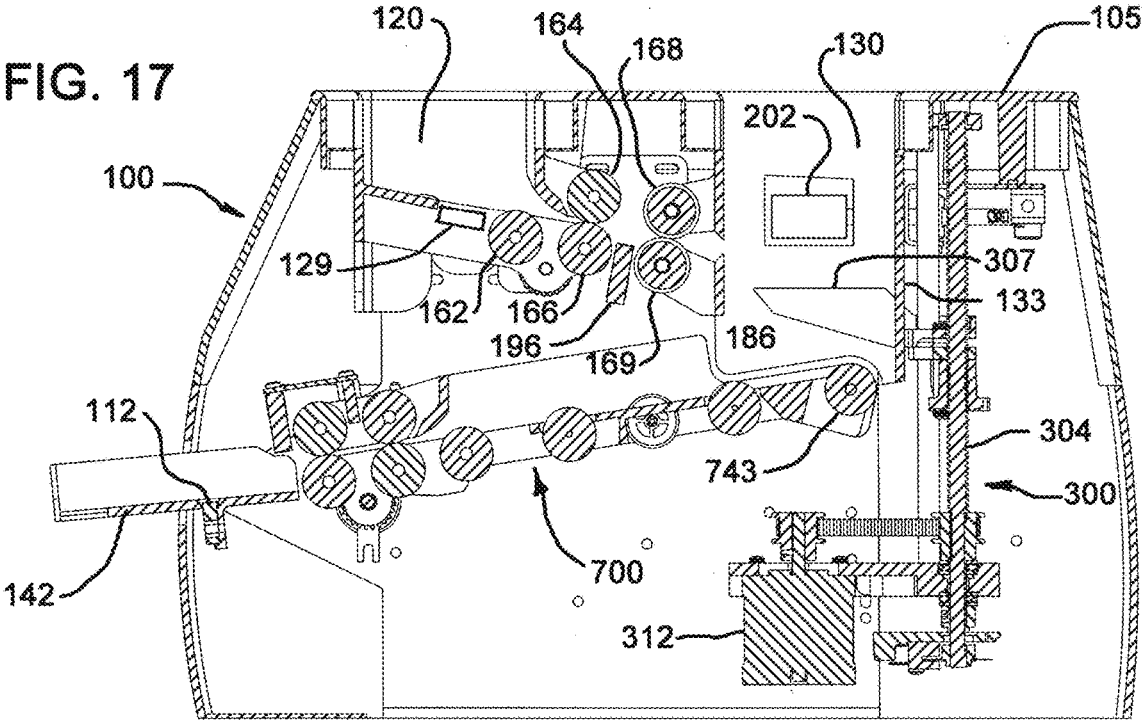
FIG. 17 is a side elevational section view which illustrates the basic layout of the card paths.

The anatomy of the apparatus 100 is briefly explained by the section view shown in FIG. 17 which is devoid of any card decks or substacks. The unshuffled deck input portal 120 is shown near the top left of the view. Feed rolls 162, 166 and 164 are utilized to move individual cards past a verification sensor 196, and additional feed rolls 168 and 169 move individual cards into the randomizer chamber 186. The housing 133 possess four walls which contain card decks with slight clearance around the periphery, thus forming the randomizing chamber 186. After the deck is randomized and successfully verified, the card deck will be supported upon elevator arms 307 which are moved vertically by the lead screw in elevator assembly 300. The elevator arms 307 move the processed deck until it contacts a transfer roll 743 which is part of the metering station 700. Contact with the transfer roll 743 causes the deck to rotate CCW and slide downward along the rolls 742 of the metering station 700. The metering station 700 thereafter issues one card at a time in rapid succession to the output tray 142 until the proper hand size is accumulated for the play-ready hand. A sensor 112 in the output tray signals the microcontroller when the substack (hand) has been removed from the output tray. In one embodiment, that signal triggers the metering assembly to automatically disgorge the next play-ready hand in rapid succession when the dealer removes the previous substack.

In the event that a card deck is found to be faulty after interrogation by the verification sensor, the microcontroller operates the elevator assembly 300 to raise the arms 307 with the rejected deck upward to a temporary storage position within the discharge cavity 130.

Figure 18A:
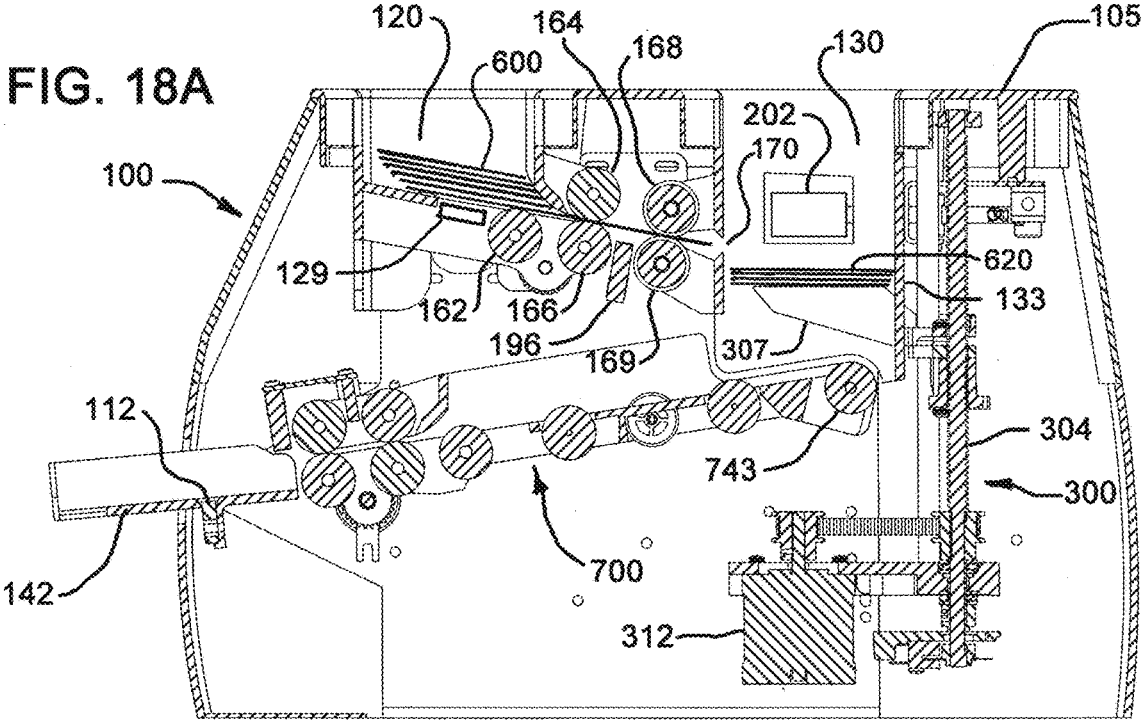
FIGS. 18A, 18B, 18C, 18D and 18E are side elevational views of the device herein which stepwise illustrate the migration of playing cards as they move through the apparatus to the output tray.

A more detailed explanation can be observed from FIGS. 18A, 18B, 18C, 18D and 18E, which explain the movement of a single card deck within and through the card handling apparatus 100. FIG. 18A shows a new or spent deck 600 (unshuffled) located in the card deck intake tray 120. When the dealer activates a shuffle command on touch panel 114, the microcontroller interrogates sensor 129 to determine if any card is present in the card intake tray 120. If a card is detected by the sensor 129, the microcontroller will activate motors (not shown) that rotate feed rolls 162, 166 and 164 until the leading edge of a card is detected by verification sensor 196.

In FIG. 18A, an unshuffled card of a card deck 600 is moved past the verification sensor 196 and is about to enter the randomizing chamber 186, where the card stack 620 is supported by elevator arms 307 of the elevator assembly 300. The microcontroller activates a motor (not shown) to rotate feed rolls 168 and 169 which feed the cards of the card stack 600 into the randomizing chamber 186 through a slot 170 in the housing 133. In a rudimentary embodiment, the verification sensor is utilized to count the cards within the deck being processed. In more advanced embodiments, the verification sensor 196 is utilized to read the rank and suit of each card in addition to counting the cards in the deck. The sensor 196 may be any optical recognition sensor as taught in the prior art, including a reflective opto-sensor, a digital camera, CMOS camera, color pixel sensor or a CCD image sensor. In the preferred embodiment, the sensor 196 is a CCD image sensor and is used to read the rank and suit in the upper right corner of each card. This optical recognition process will continue until sensor 129 signals that no more cards are available in the card input portal 120. Upon completion of the deck insertion into the randomizing chamber 186, the microcontroller will determine if any fault condition exists, which may include card shortages, extra cards, flipped cards or unreadable cards.

Figure 18B:
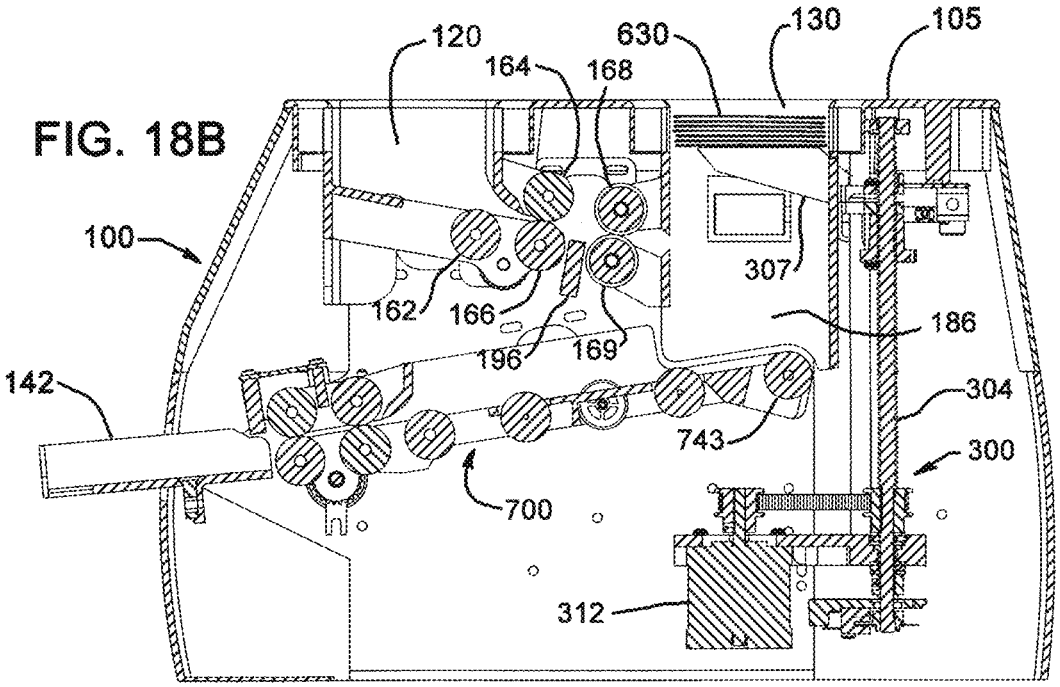

After the randomizing cycle is completed, the microcontroller decides if a card deck is faulty. If the card deck is faulty, the elevator arms 307 will raise the rejected card deck 630 to the faulty deck discharge portal 130 as shown in FIG. 18B and signal the fault condition on the touch panel 114. The automatic rejection of a faulty card deck relieves the dealer of any distraction or interruption in table play that would otherwise require a dealer to tediously unload a shuffling apparatus as in the case of conventional compartment type shufflers. Moreover, the device denies the dealer the discretion to continue play with a corrupt card deck as in the case of player-dealer collusion.

Figure 18C:
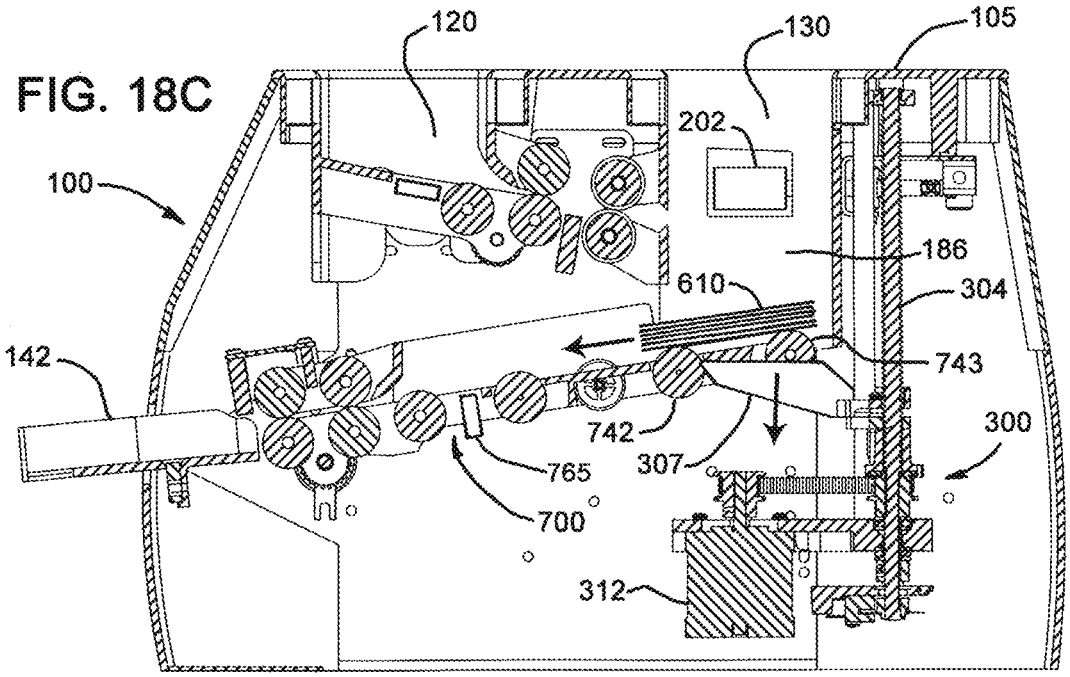
Figure 18D:
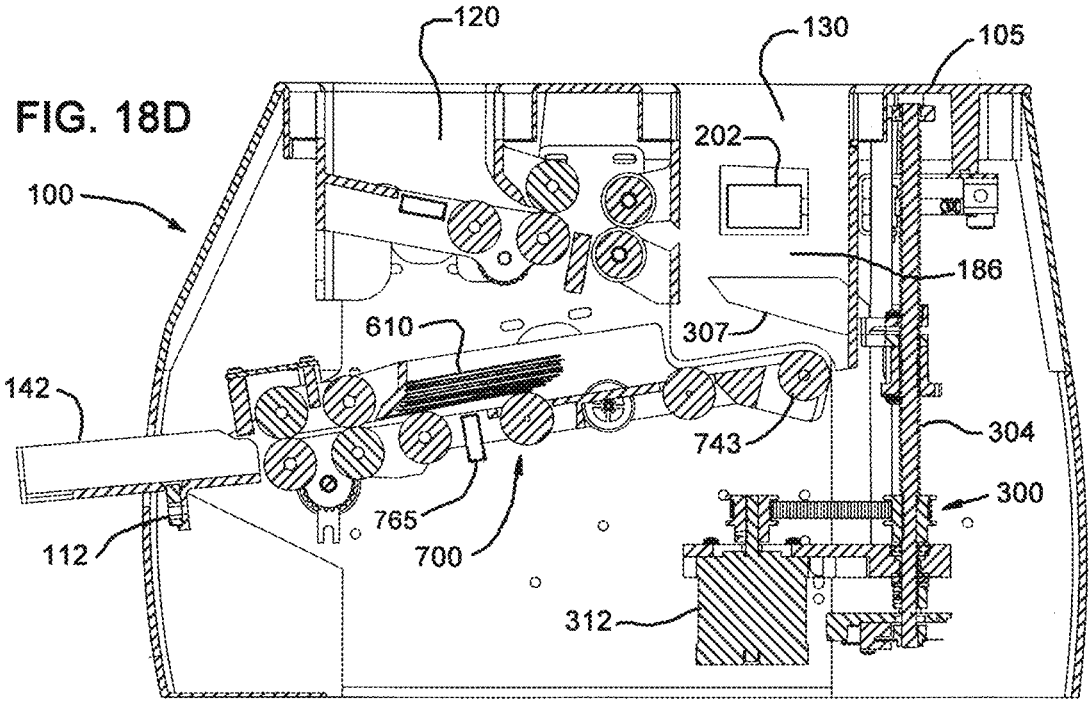
Figure 18E:
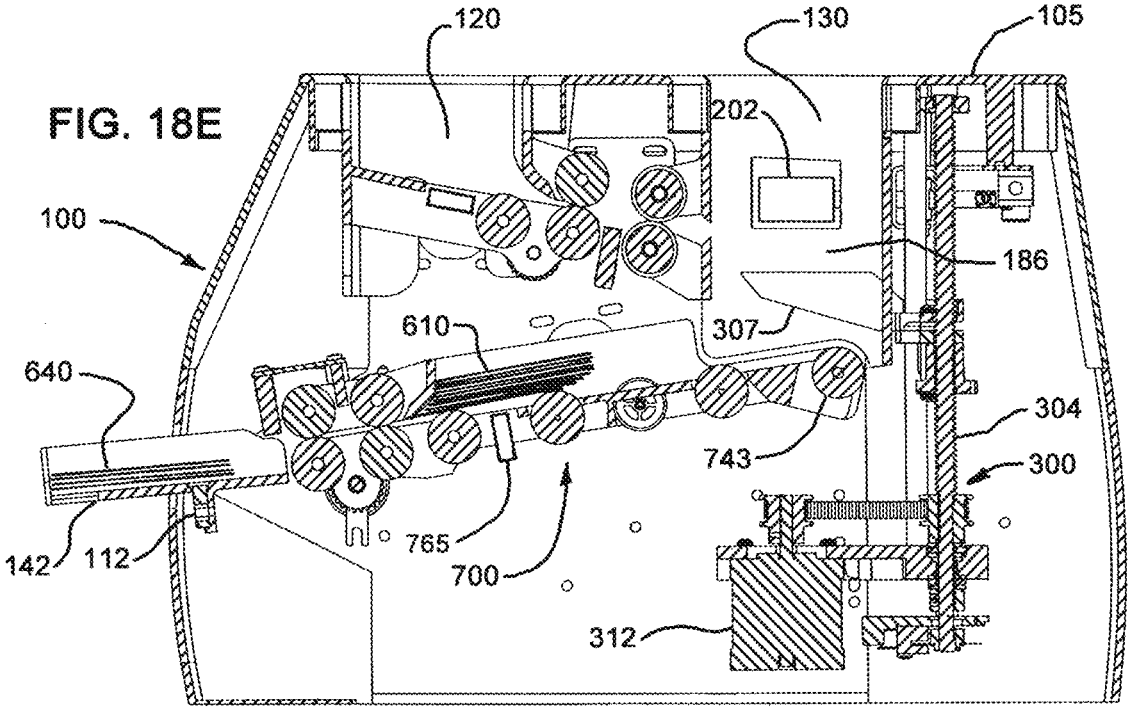

FIG. 18C illustrates the case in which the microcontroller has determined that a card deck is not faulty and lowered the elevator arms 307 to a position below the transfer roll 743. The forked shape of the elevator arms 307 allows the elevator arms 307 to pass by and below the freely rotatable transfer roll 743 and the adjacent roll 142. The two rolls 742 and 743 takeover support of the verified card deck 610 and create centrifugal force that discharges the deck 610 in the direction of the arrow along rollers of the metering station 700. It is noted that in this figure, the elevator arms 307 have passed below the discharge roll 743 and the verified card deck 610 has just begun to move along the discharge rolls 742 of the metering station 700. FIG. 18D shows the verified card deck 610 at the metering station (explained below) and FIG. 18E shows a play-ready hand 640 after having been discharged from the metering station.

The randomizing cycle comprises a series of motions performed by the apparatus to sort the individual cards into a randomly arranged deck within the chamber 186. The randomizing cycle will automatically start when the dealer activates the "Shuffle" command on the touch screen as long as sensor 129 detects the presence of a card in the input portal 120. Referring to FIG. 18A, a series of feed rolls 162, 166, and 164 strip the bottom card from the stack of cards 600 and move that card past the verifications sensor 196. Feed rolls 168 and 169 then inject each card into the randomizer chamber 186, whereupon each card is inserted into a growing card stack 620.

Figure 19:
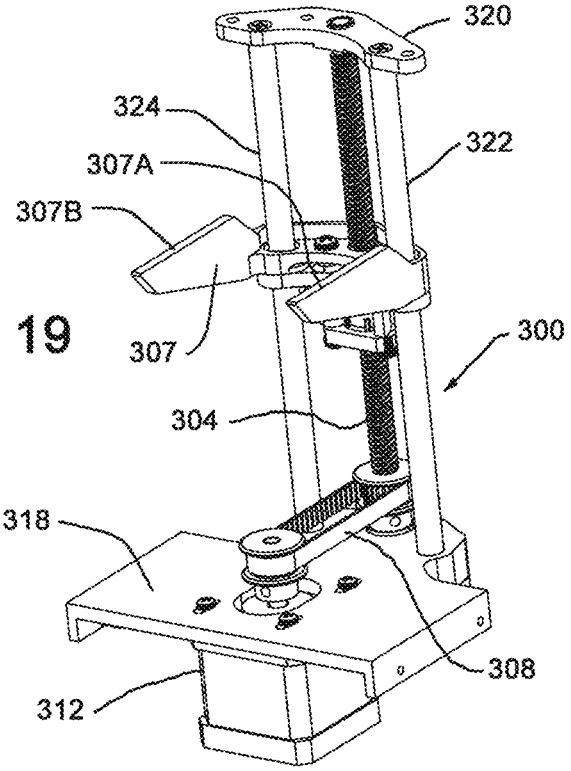
FIG. 19 is an isometric view of the elevator module.
Figure 20:
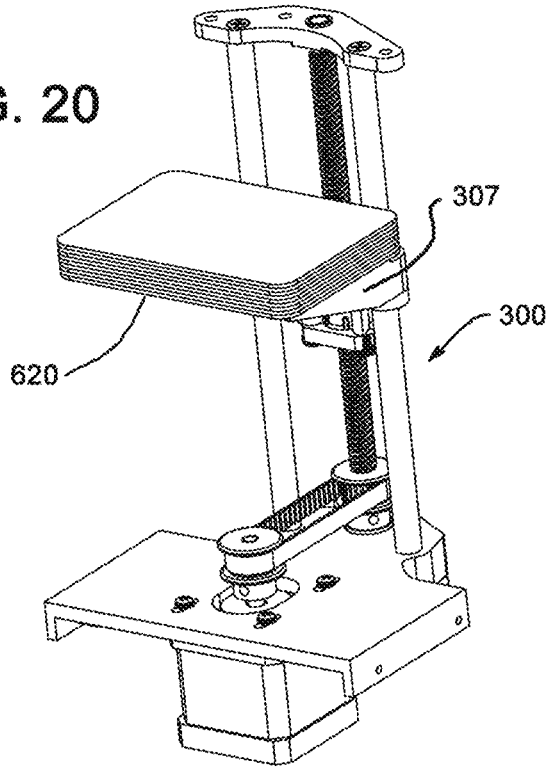
FIG. 20 is an isometric view of the elevator module showing the position of a subset of randomized cards.

The randomizing chamber 186 possesses an elevator surface comprising elevator arms 307 which support the card stack 620 during randomization, and move the card stack 620 with oscillation motion in a direction parallel to the walls within the randomizing chamber 186 (FIG. 18A). The structure of the elevator assembly 300 and its driving means is shown in FIG. 19. The elevator assembly 300 has two fork-shaped arms 307, which are moved vertically by motion of a lead screw 304. Each elevator arm 307 possesses a support surface for supporting card stacks as identified by labels 307A and 307B. Guide shafts 324 and 322 prevent torsional movement of the elevator arms 307, and are attached to platform 318 to which a stepper motor 312 is mounted. The upper portion of elevator assembly 300 is stabilized by bridge 320. The stepper motor 312 rotates the lead screw 304 by means of a timing belt 308. The orientation of a card stack 620 is shown when in transit on the elevator in FIG. 20. As shown in FIG. 18A, the two elevator arms 307 of the elevator penetrate the randomizing chamber 186 through access slots (not shown) in the wall 133 of the randomizing chamber 186, such that the elevator arms 307 may move freely in a direction parallel to the chamber walls. At the same time, the card stack on the elevator arms 307 is loosely constrained laterally on four sides by the chamber walls of randomizing chamber 186.

Figure 21:
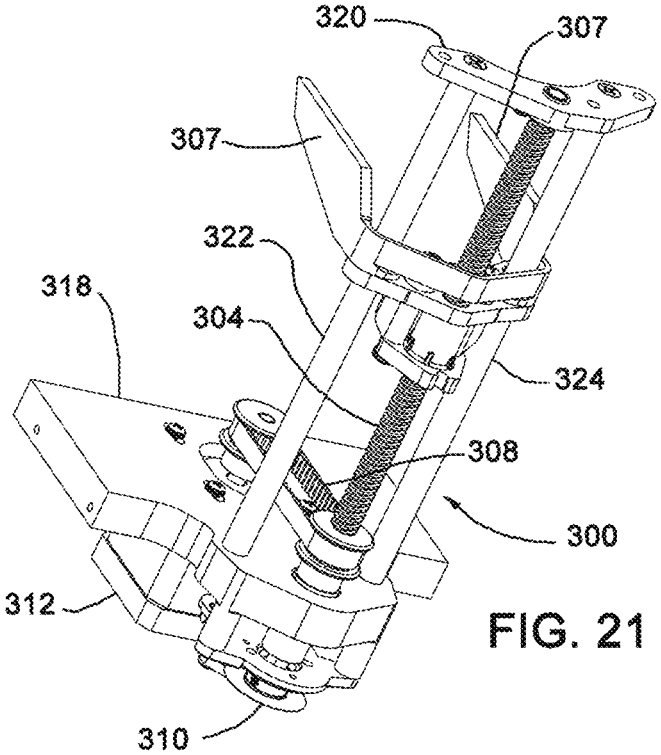
FIG. 21 is an isometric view of the elevator module.

The elevator movement is controlled in very fine increments by the stepper motor 312 in conjunction with an incremental encoder 310 which is mounted to the lead screw 304 as shown in FIG. 21. An encoder disc of the incremental encoder 310 has 200 increments per revolution which corresponds to each step of a 200 step per revolution step motor. The ratio of the lead screw 304 rotation to the elevator arm 307 linear motion is 4 millimeters per revolution. The stepper motor 310 can therefore control the elevator arms 307 in increments of 20 microns, where 1 micron equals one-millionth of a meter. The thickness of a typical playing card is approximately 300 microns. Thus, the stepper motor can therefore move the elevator arms 307 with the precision of 1/15th of the card thickness. In other words, 15 motor steps move the elevator arms 307 one card thickness. This high ratio makes the elevator mechanism controllable in fine increments, thus intolerant to positional error. Rather than the incremental encoder 310, other types of sensors could be used to monitor the linear movement of the elevator, as is known and practiced in the art.

Figure 11:
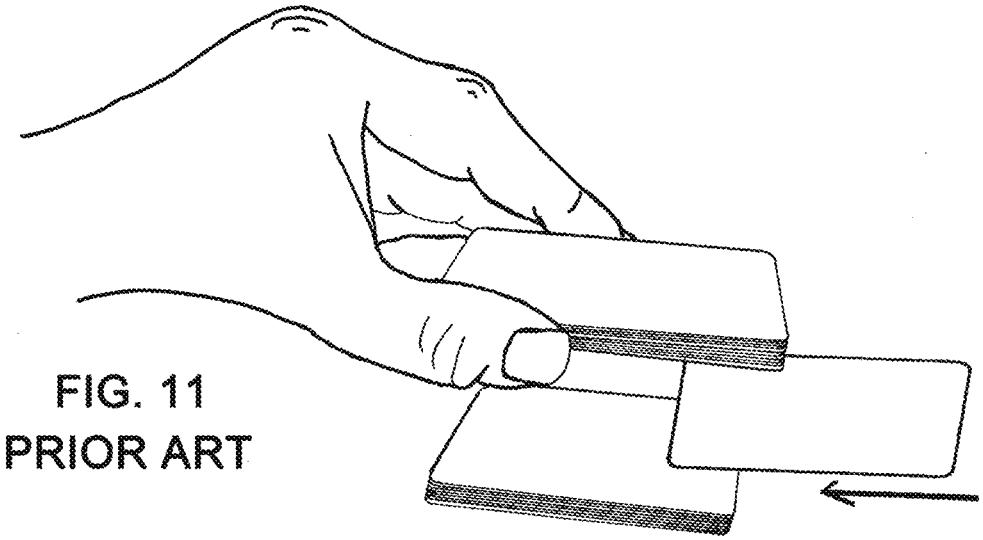
FIG. 11 PRIOR ART
FIG. 11 illustrates the insertion of a "cut card" into a card stack by a dealer, which is emulated by the mechanical gripper mechanism of FIG. 10.
Figure 12A:
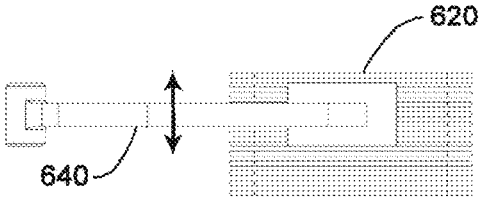
FIG. 12A PRIOR ART
FIGS. 12A, 12B, 13A and 13B compare the operating sequences of two prior art randomizing methods that utilize gripper mechanisms.
Figure 12B:
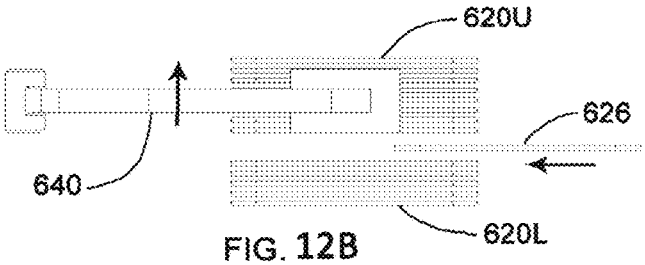
FIG. 12B PRIOR ART
Figure 13A:
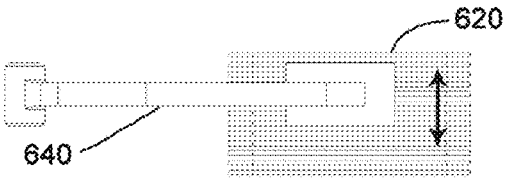
FIG. 13A PRIOR ART
Figure 13B:
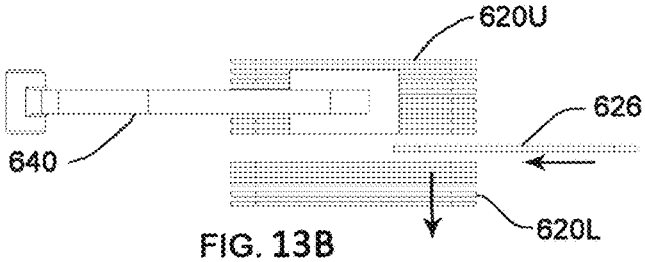
FIG. 13B PRIOR ART
Figure 14:
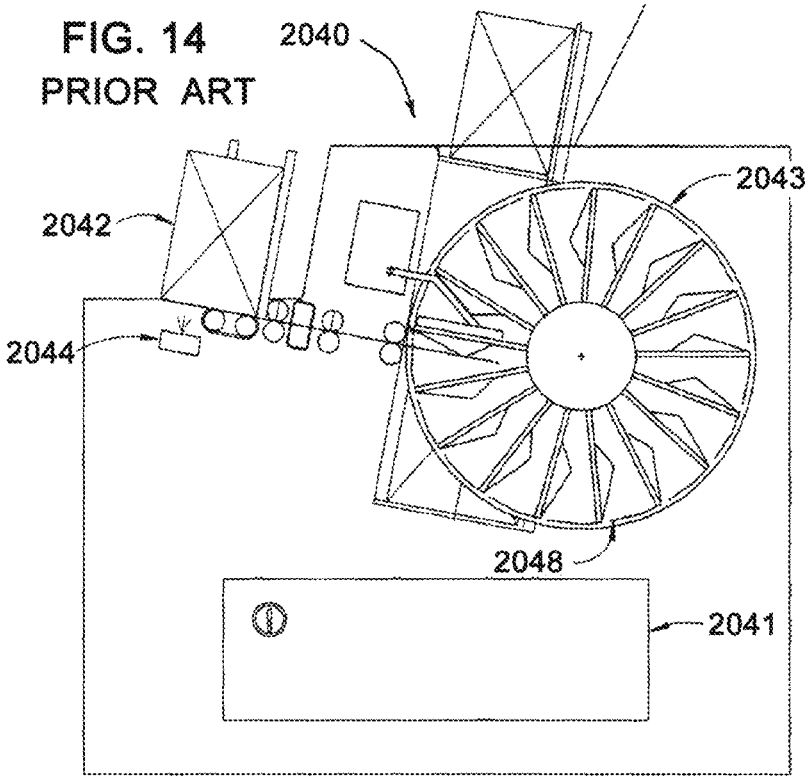
FIG. 14 PRIOR ART
FIG. 14. illustrates a prior art (1999) randomizing mechanism that interrogates each card before entering its randomizing mechanism.
Figure 22:
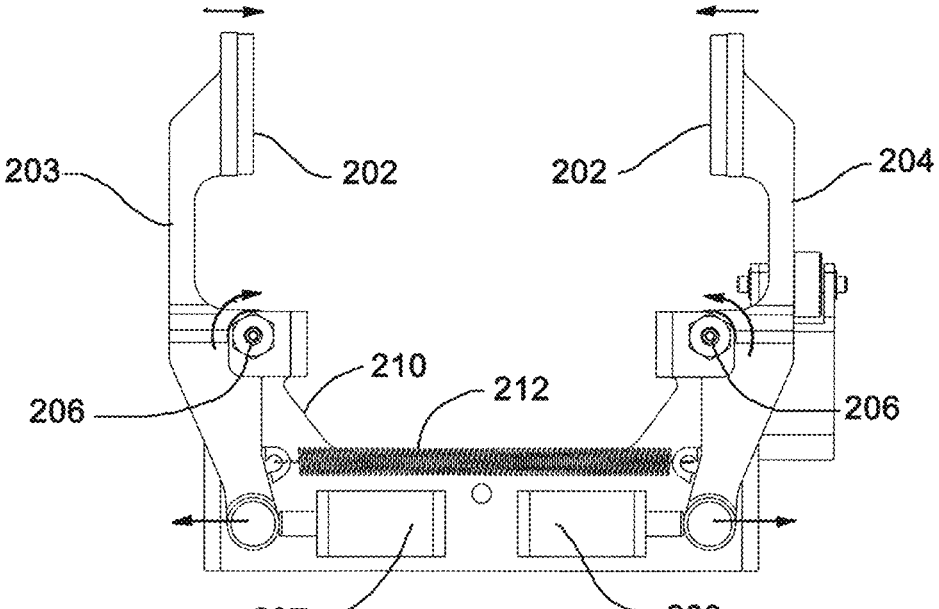
FIG. 22 is a planar view of the gripper mechanism used to randomize cards.
Figure 24:
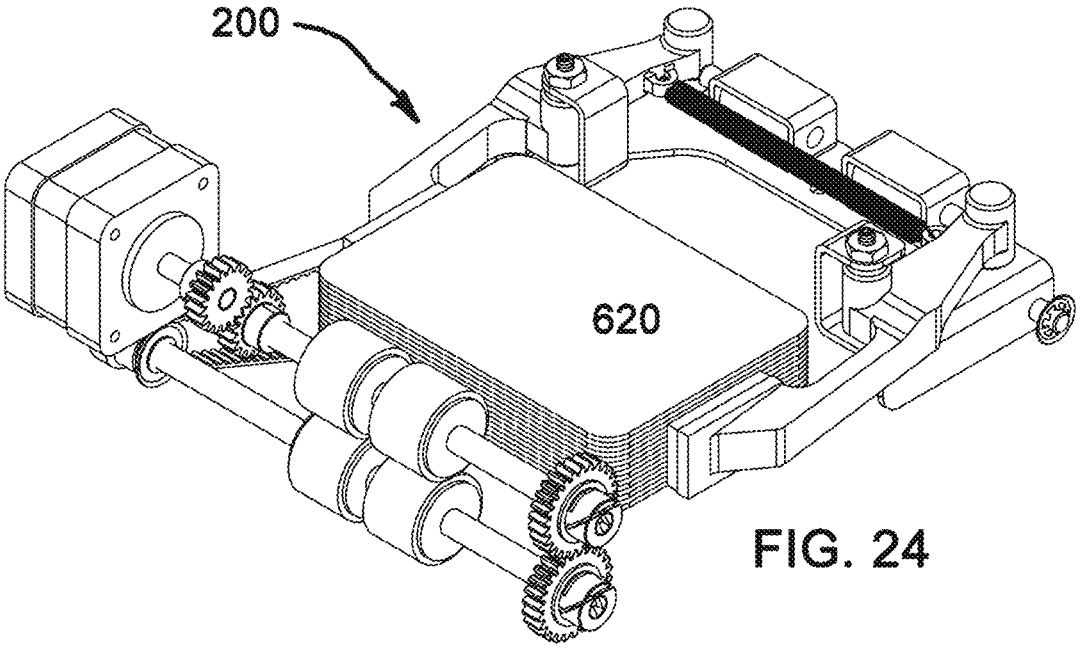
FIG. 24 is an isometric view of the gripper mechanism while grasping a stack of cards.

The randomizing method emulates the motion of a human dealer when cutting a card into a card deck as shown in prior art FIG. 11. The gripper assembly 200 emulates the gripping motion of a dealer's fingers as shown in FIG. 22. Two gripper pads 202 are mounted on the terminal ends of a first gripper arm 203 and a second gripper arm 204, with each pivoting upon pivot screws 206. The two arms are actuated by two small solenoids 207 and 208 which are mounted on the gripper frame 210. When the solenoids are activated, the arms 203, 204 and their associated pads 202 move in the direction of the arrows to pinch the lateral surfaces of a card stack as shown in FIG. 24. Upon deactivation of the solenoids 207, 208, the two arms 203, 204 are moved in the reverse direction by spring 212, which relaxes the grip and releases the card stack 620. In the relaxed position, there exists only slight clearance between the gripper pads 202 and the lateral surface of card stack 620.

Figure 23:
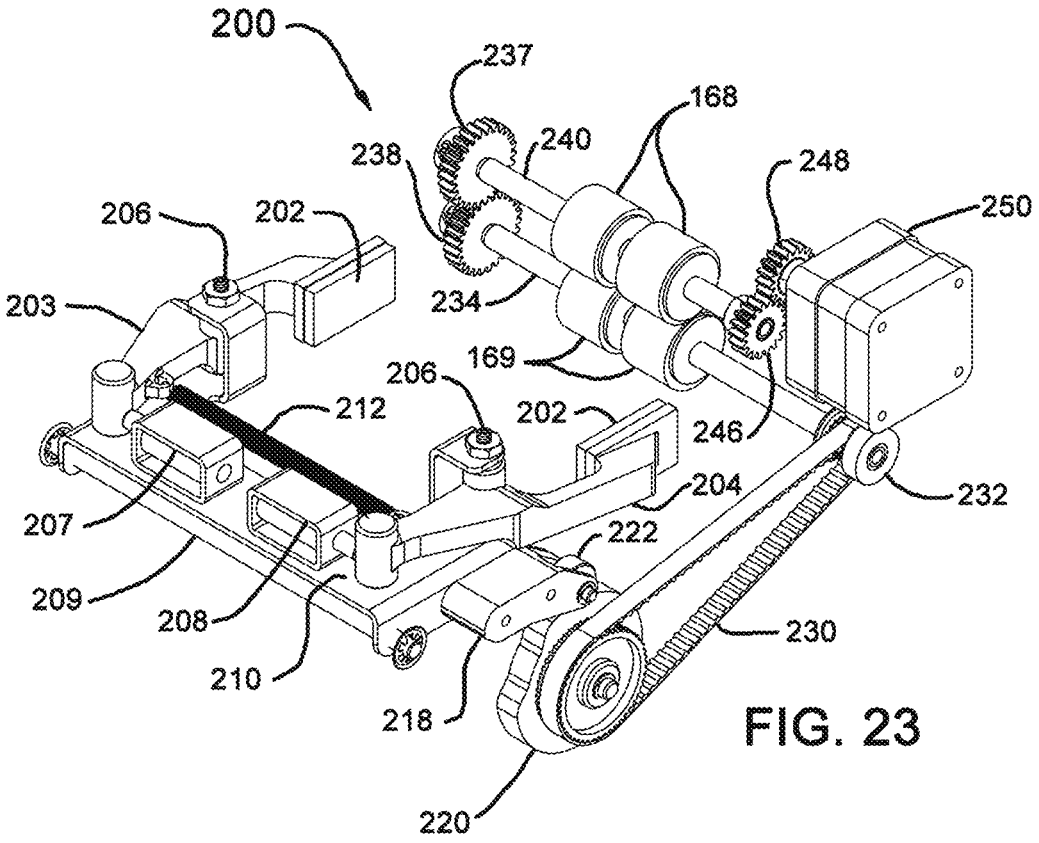
FIG. 23 is an isometric view of the of the gripper mechanism which is used to grasp and raise a sub-stack of randomized cards.
Figure 25:
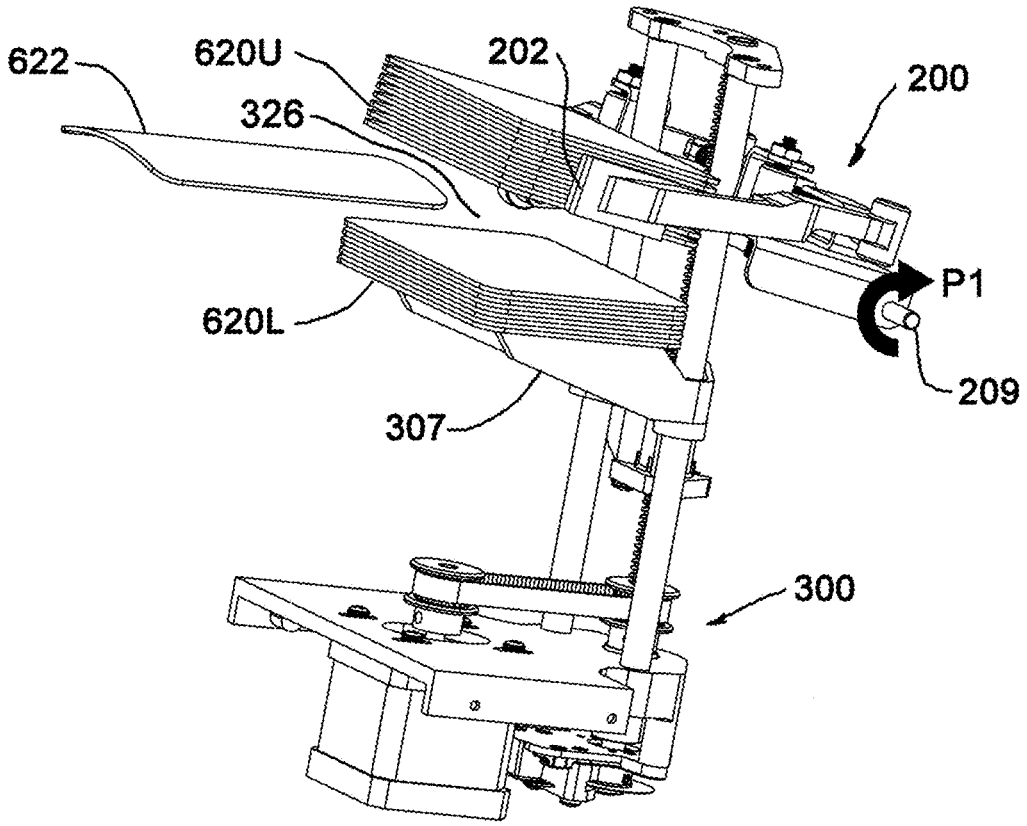
FIG. 25 is an isometric view of the gripper mechanism creating a random wedge-shaped opening between two sub-stacks of cards.

The complete gripper assembly 200 is shown in FIG. 23 where the gripper frame 210 is pivotally mounted on a shaft 209. The pivotal mount allows the gripper frame 210, including gripper arms 203 and 204, to move in an arc after the gripper solenoids 207, 208 have been activated. A cam follower roll 222 is mounted to the follower mount 218 which is rigidly attached to the gripper frame 210. During the gripping cycle, at least one card of the card stack 620 is grasped by the gripper arms 203 and 204, and thereafter lifted by the cam 220 to move an upper sub-stack of cards 620U upward through an arc. The motion is illustrated in FIG. 25 where the upper sub-stack is shown as 620U.

Figure 26:
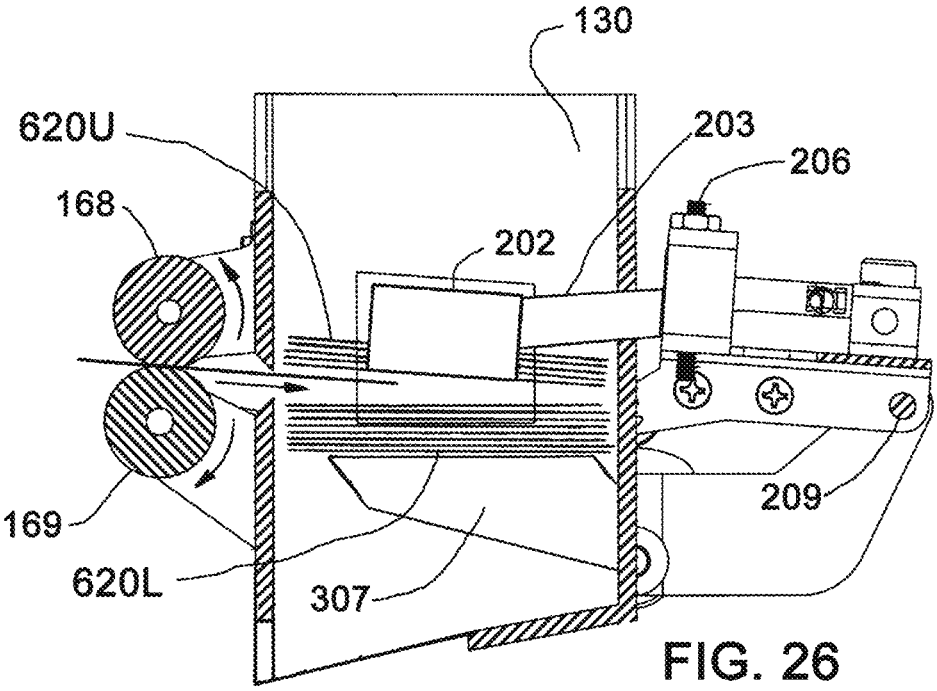
FIG. 26 is a cutaway side view of the randomizing apparatus showing a card being inserted into a randomly-created wedge-shaped opening in the receiving card stack.
Figure 27:
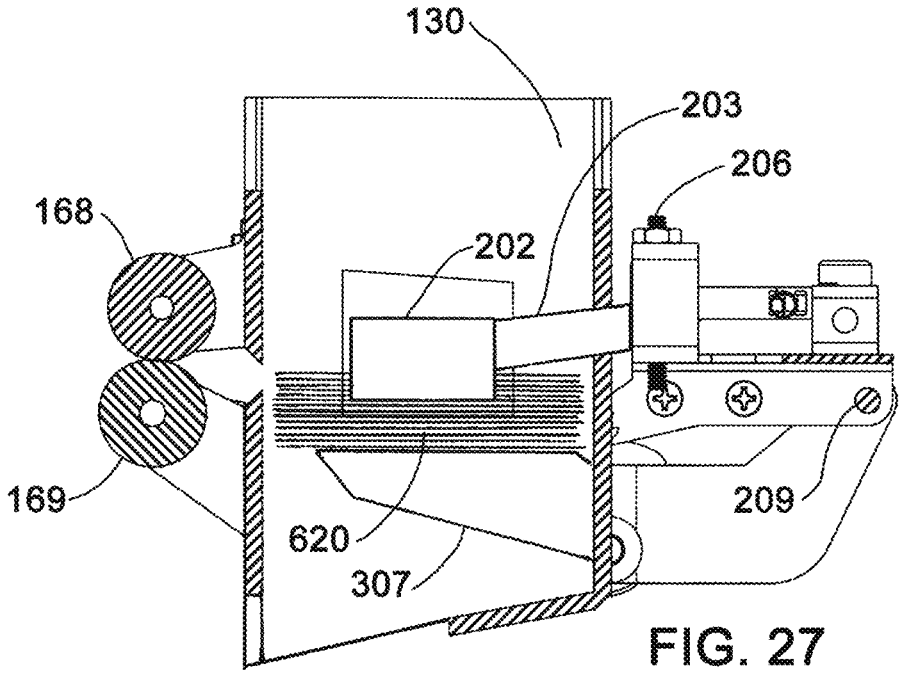
FIG. 27 is a side elevational section view of the randomizing apparatus showing the receiving card stack after the upper sub-stack has been lowered onto the newly inserted card by the gripper mechanism.

The elevator assembly 300 is used to position a card stack relative to the gripper mechanism 200, in order to allow the gripper assembly 200 to split the card stack into two sub-stacks, 620U, 620L. The orientation between the elevated, upper sub-stack 620U, the gripper assembly 200, the lower sub-stack 620L, and the elevator assembly 300 is shown in FIG. 25. A lower card sub-stack 620L is shown supported by the elevator arms 307, while an upper card sub-stack 620U is shown lifted in an arc about pivot P1 which is locationally fixed to the frame of apparatus 100. The vertical position of the split between the upper sub-stack 620U and the lower sub-stack 620L is determined by the microcontroller which relocates the elevator arms 307 just prior to the gripping cycle. As shown in side elevation views of FIG. 26 and FIG. 27, the elevator arms 307 position a card stack 620 in a randomly selected elevation and the gripper assembly 200 thereafter splits the card stack through an arc at the random location. The lower sub-stack 620L is held stationary by the elevator arms 307 while the gripper arms 203, 204 raises the upper sub-stack 620U, and while a new card 622 is inserted into the wedge-shaped opening 326. As illustrated in FIG. 25, the axis of the elevator may form an angle with the surface of the casino table that is other than perpendicular.

Figure 2:
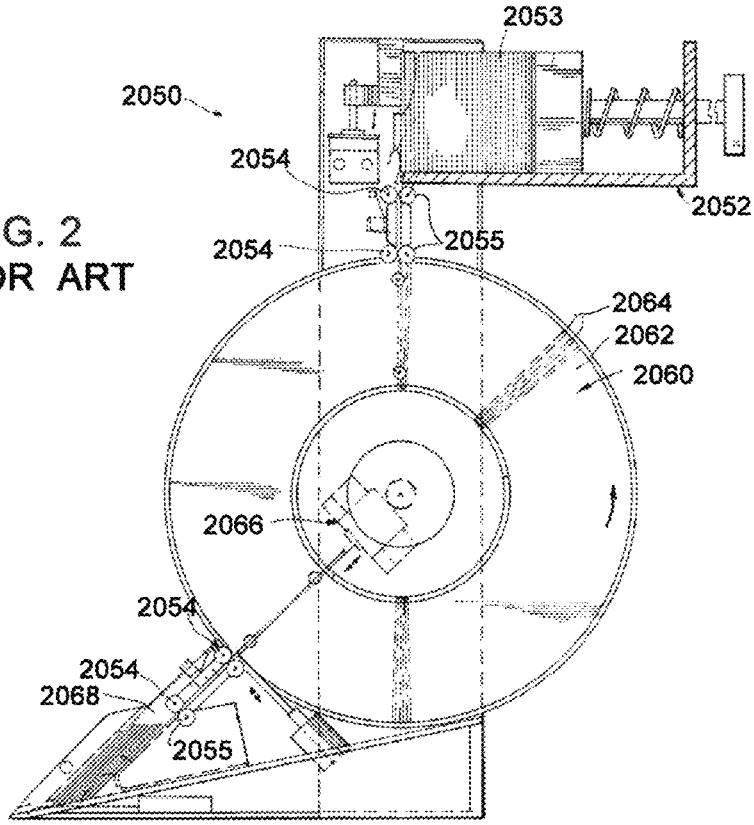
FIG. 2 PRIOR ART
FIG. 2 is a perspective view from a prior art (1986) carousel shuffler patent disclosure.
Figure 3A:
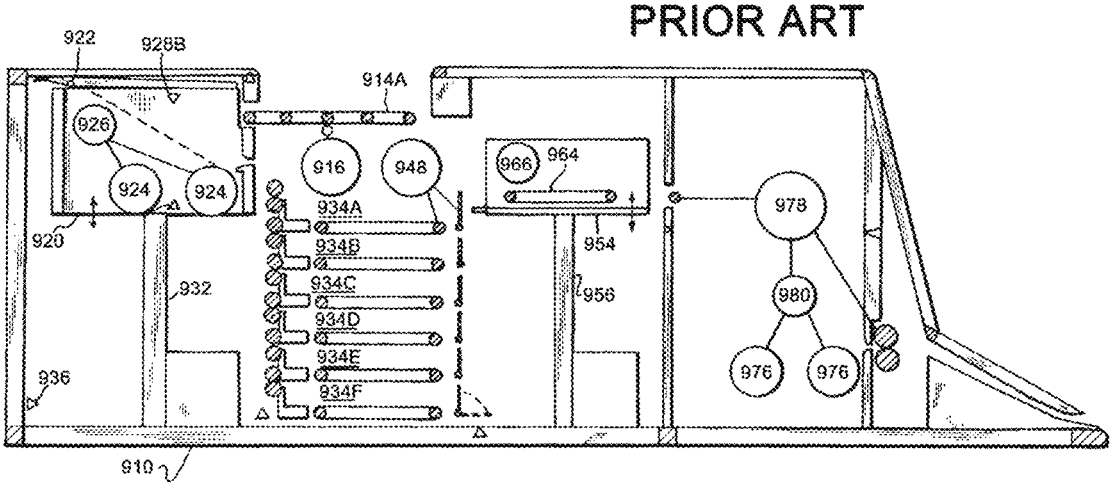
FIG. 3A PRIOR ART
FIG. 3A is a side elevation view from a prior art (1988) elevator shuffler patent disclosure.
Figure 3B:
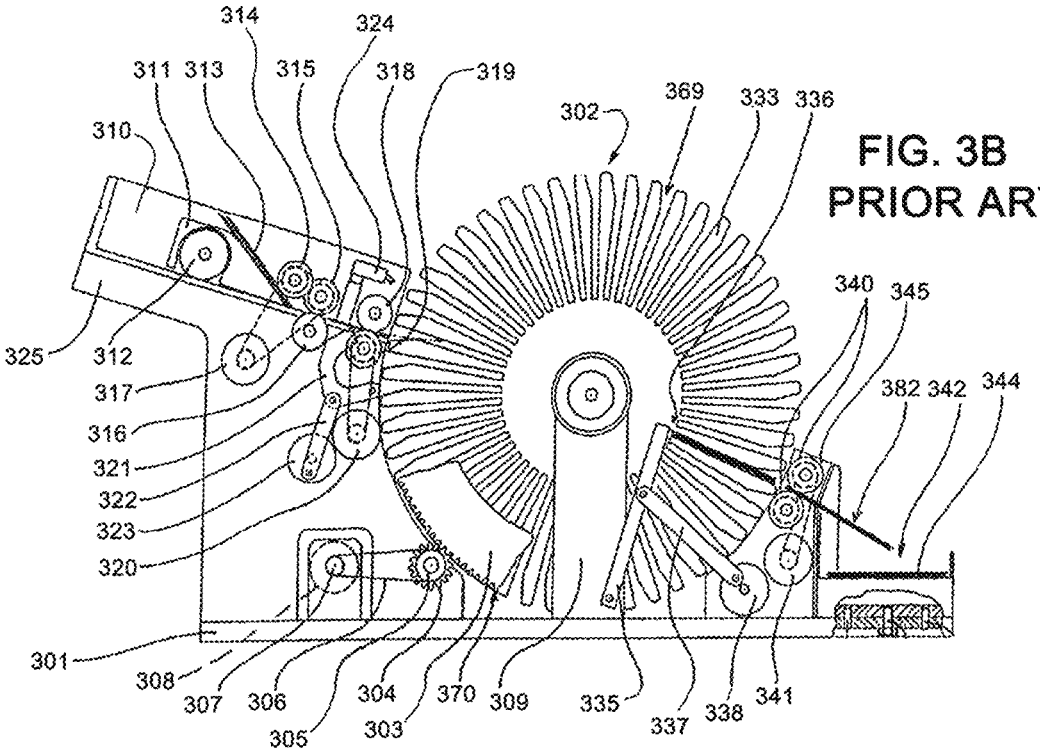
FIG. 3B PRIOR ART
FIG. 3B is a side elevation view from a prior art (2003) carousel shuffler patent disclosure.
Figure 4:
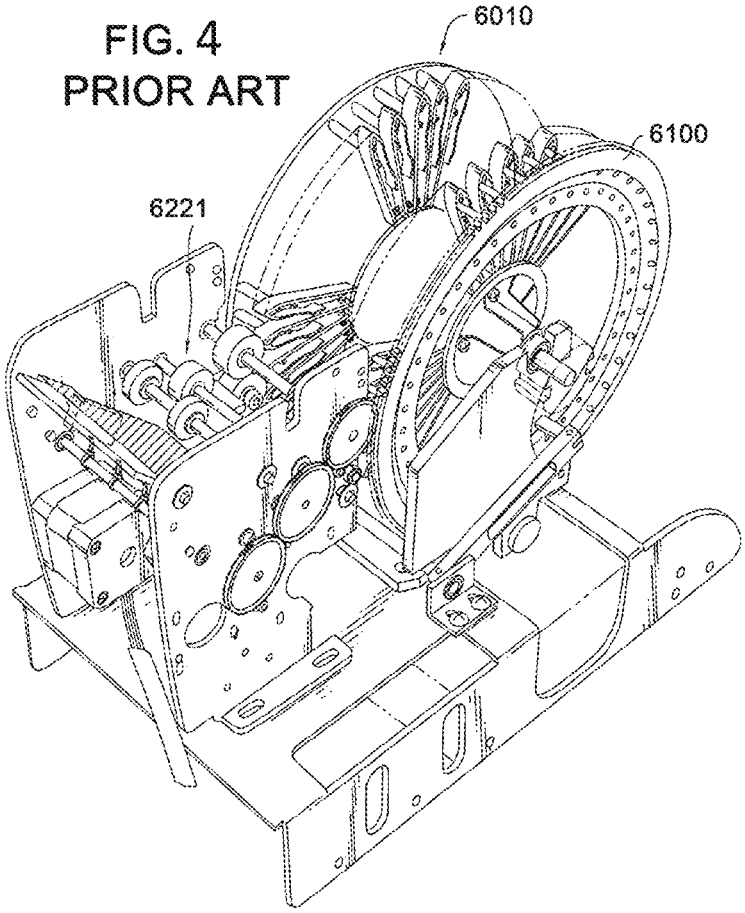
FIG. 4 PRIOR ART
FIG. 4 is perspective view from another prior art (2009) carousel shuffler patent disclosure.
Figure 5:
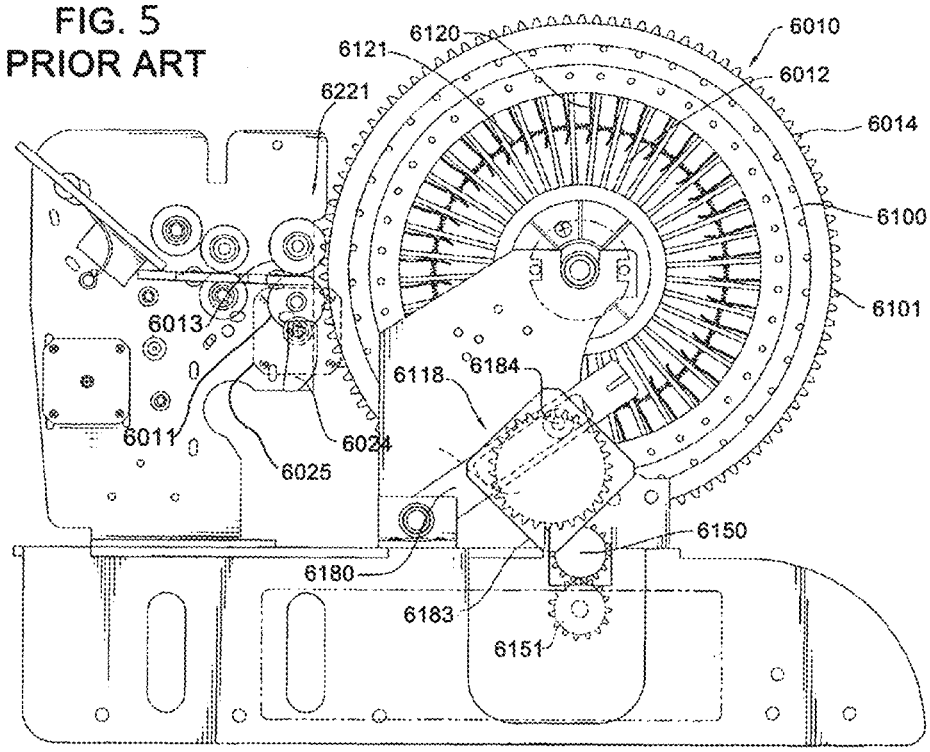
FIG. 5 PRIOR ART
FIG. 5 is a side elevation view from the prior art carousel shuffler patent disclosure in FIG. 4.
Figure 6:
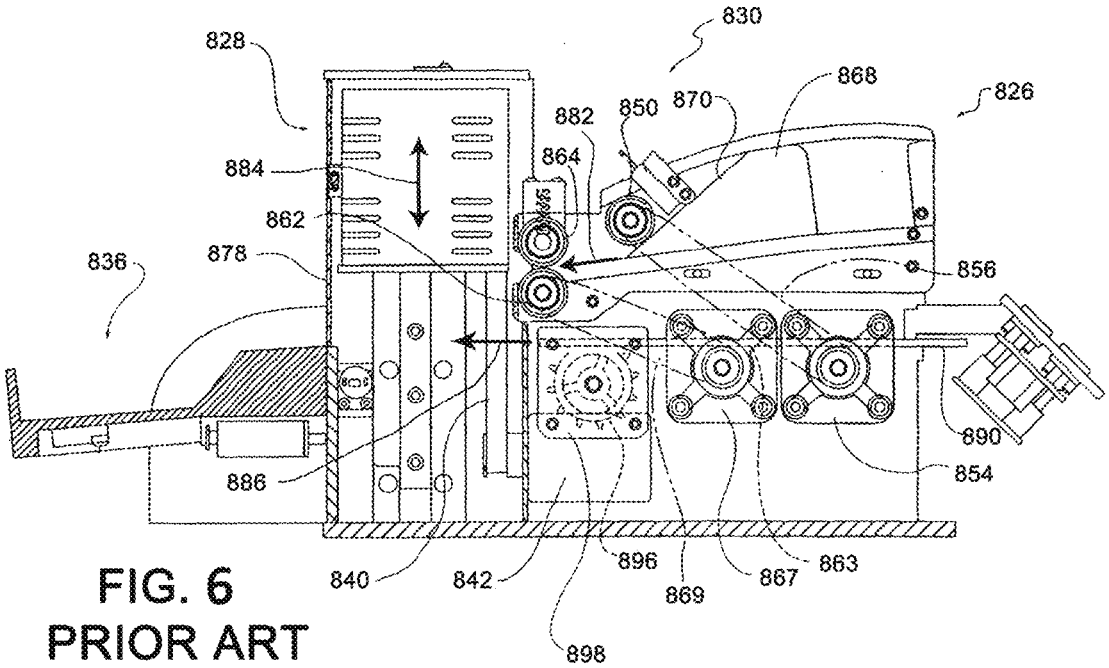
FIG. 6 PRIOR ART
FIG. 6 is a side elevation view from a prior art (2000) elevator shuffler patent disclosure.
Figure 7:
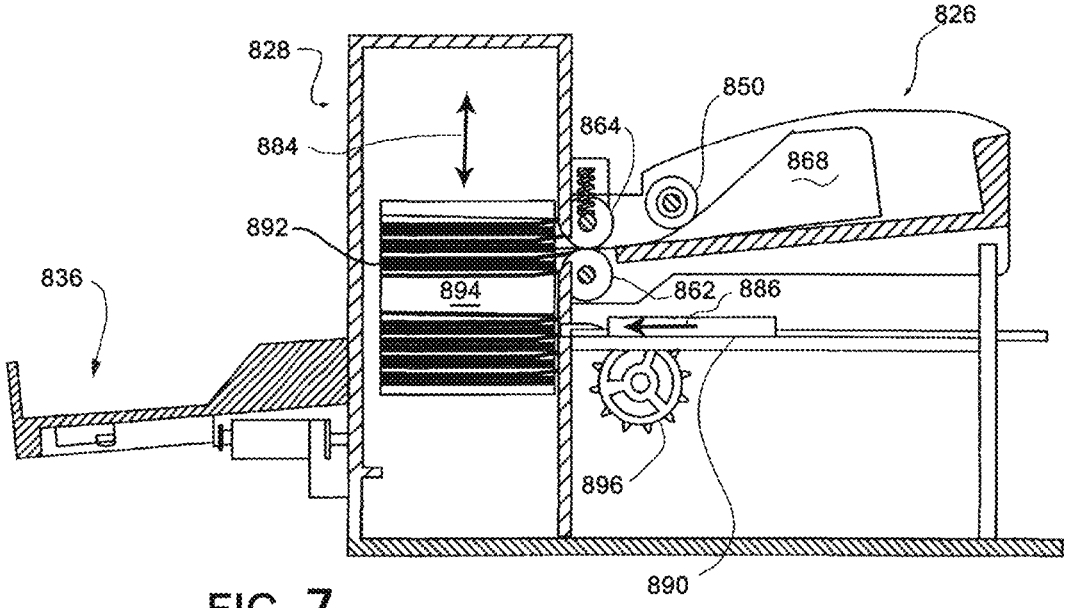
FIG. 7 PRIOR ART
FIG. 7 is another view from the prior art carousel shuffler patent disclosure in FIG. 6.
Figure 8:
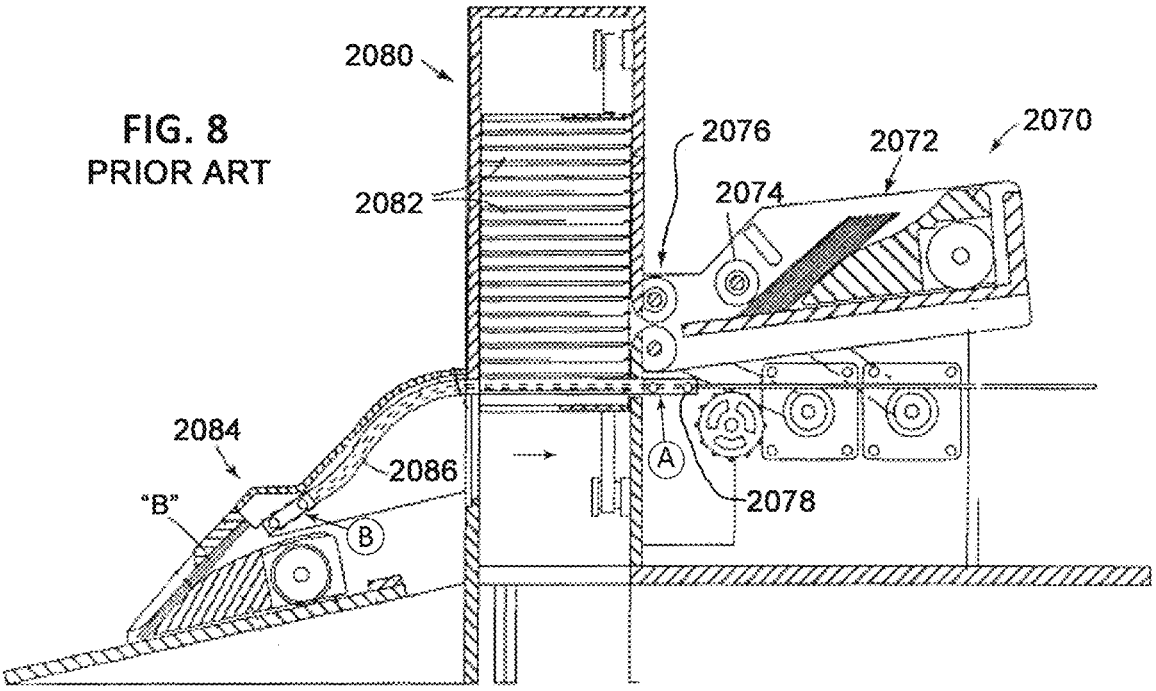
FIG. 8 PRIOR ART
FIG. 8 is a side elevation view from a prior art (2003) elevator shuffler patent disclosure.
Figure 9:
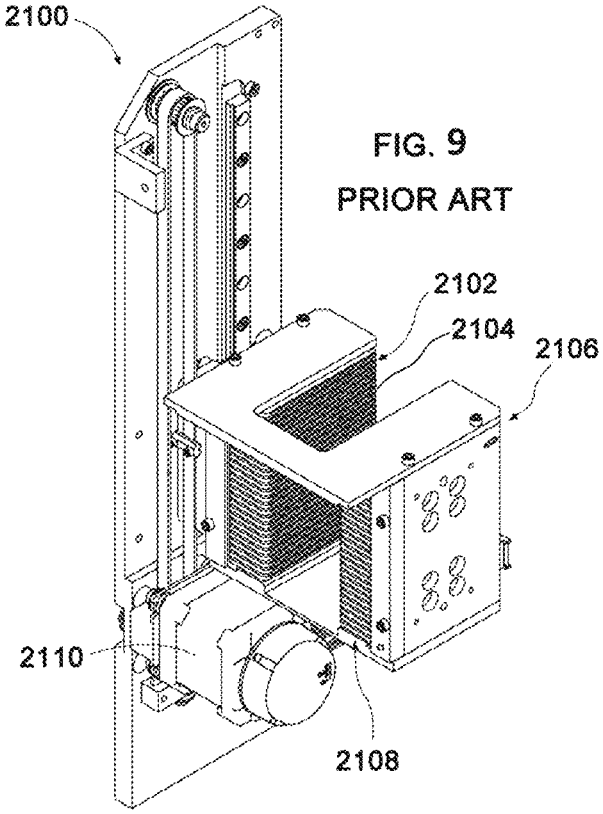
FIG. 9 PRIOR ART
FIG. 9 illustrates the configuration of a prior art (2022) randomizing mechanism which utilizes a vertically moving comb with narrow card slots.
Figure 10:
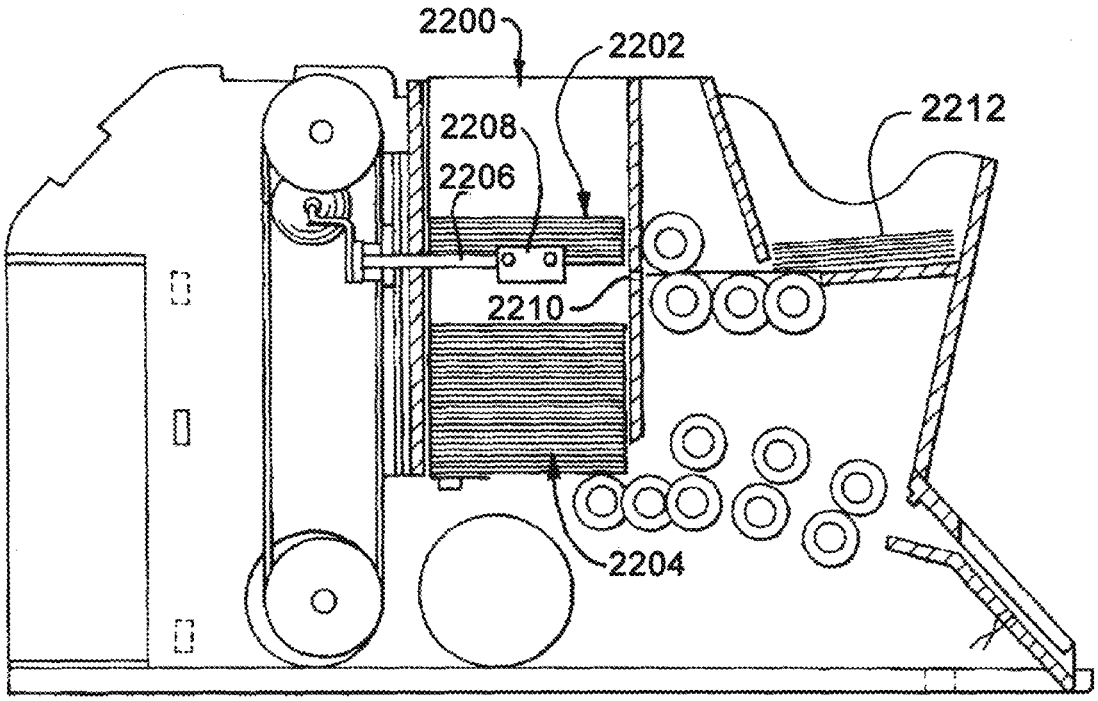
FIG. 10 PRIOR ART
FIG. 10 illustrates a prior art (1997) randomizing mechanism which utilizes a mechanical gripper to separate a card stack at random positions, thus enabling the insertion of an individual card from a secondary deck (unshuffled deck).

The purpose of the cam 220 shown in FIG. 23 is two-fold. First, the gripper assembly 200 creates a large wedge-shaped opening 326 which is tolerant to curved or bent cards as illustrated by warped card 622 in FIG. 25. The large wedge-shaped opening 326 overcomes the jamming problem exhibited by prior art narrow slot carousel and moving comb shuffling devices shown in FIG. 2, FIG. 8 and FIG. 9. Secondly, the cam 220 is designed to alleviate the cyclic life burden on the components of the elevator assembly 300. The prior art devices that utilized gripper mechanisms (see prior art FIG. 12A through FIG. 13B) required three elevator motions for each card insertion; a first elevator motion to arrive at the splitting plane; a second elevator motion to split the deck into two sub-stacks; and a third elevator motion to merge the two sub-stacks together after each card insertion. For one deck of 52 cards, for example, the prior art elevators must shuttle through 156 (3×52) motion cycles. In contrast, the elevator assembly 300 of the embodiments herein relocates just once during each card insertion cycle, thereby extending the service life of the elevator assembly 300 as compared to the prior art.

The previously described grasp-elevate-insert-release cycle is repeated for each of the cards in an unshuffled deck until all cards have been transferred to the card stack 620 in the randomizing chamber 186. The card stack 620 thus begins with one card and builds to a full deck of 52 cards in the case that 52 cards is the desired deck size. Each new card is inserted into the card stack 620 at randomly chosen elevated positions by the microcontroller, which utilizes a random number generating algorithm to determine the height of each plane between two adjacent cards within the receiving card stack 620.

Termination of the randomizing cycle is detected by the microcontroller via sensor 129 (see FIG. 18A). Upon termination of the randomizing cycle, the microcontroller will determine if the shuffled card deck 620 is faulty. If the card deck 620 is not faulty, the microcontroller will check the status of the sensor 765 (FIG. 18D) in the metering station 700 and thereafter direct the elevator to lower the deck to the metering station 700 as shown in FIG. 18C. Conversely, if the resulting shuffled deck has been found faulty after the randomizing cycle has been completed, the elevator arms 307 will raise the faulty card deck 630 to the rejected deck discharge portal 130 as shown in FIG. 18B.

Figure 28:
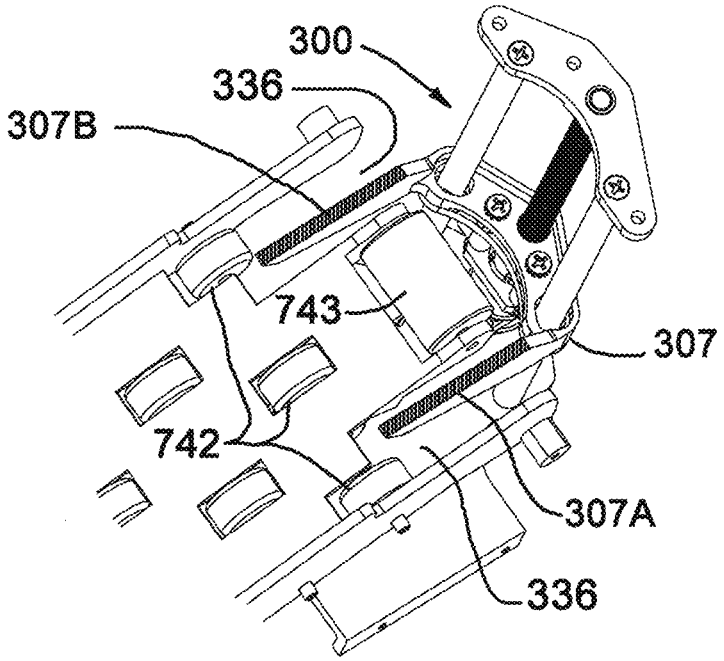
FIG. 28 is an isometric view showing the elevator arms recessed into openings below the transfer roll.
Figure 29A:
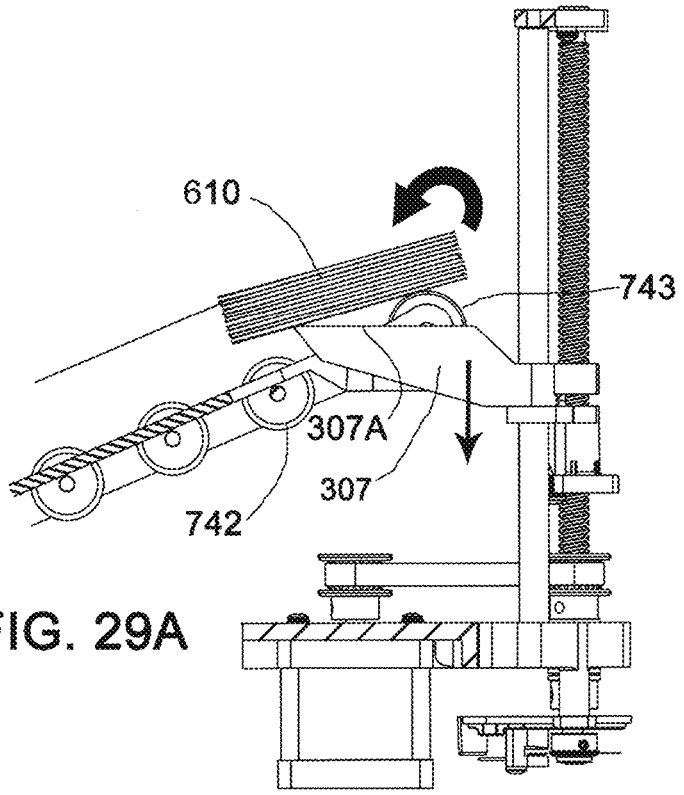
FIGS. 29A and 29B are cutaway isometric views showing a sequence of movements as the transfer roll removes a card deck from the slot-less elevator.
Figure 29B:
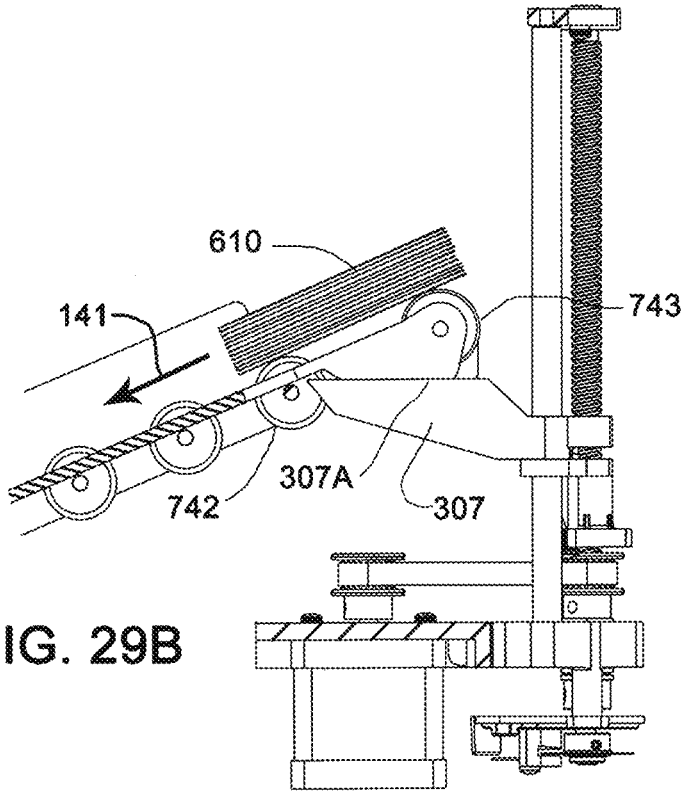

FIG. 28 illustrates an isometric view of the elevator support surfaces 307A and 307B when the elevator arms 307 are withdrawn to its lowest elevation to release a verified card deck to the metering assembly 700. In FIG. 28, the support surfaces 307A and 307B are crosshatched to help illustrate their position in the recessed openings 336 which surround the lateral sides of transfer roll 743. FIGS. 29A and 29B show isolated section views with the elevator assembly 300 and metering station 700 showing the process of transferring the verified card deck 610 to the transfer roll 743 of the metering station. As the elevator arms 307 are lowered toward a discharge position in FIG. 29A, the verified card deck 610 first makes contact with transfer roll 743, near one edge of the deck, which induces the verified card deck 610 to begin rotating counterclockwise as indicated by the circular arrow. In FIG. 29A, the verified card deck 610 is partially supported by the elevator surface 307A which is moving downward toward a recessed position. As the elevator arms 307 continue moving downward, the verified card deck 610 rotates until gaining additional support from roll 742 as shown in FIG. 29B. Centrifugal force is induced by the sudden rotation and is utilized to change the direction of the card deck to the direction of the arrow 141 where inertia thereafter takes the card deck to the circular abutment surface 760 in the metering station (see FIG. 18D). The transfer from the elevator arms 307 to the metering station 700 thus takes place by centrifugal force and inertia. It is noted that in FIG. 29B, the elevator arms 307 are in a fully retracted "discharge position" where the elevator arms 307 reside temporarily until the verified card deck 610 reaches the curvilinear abutment surface 760 of the metering station. The elevator arms 307 may thereafter be raised to the randomizing chamber 186 whereupon the randomization of a second deck can commence. The device configuration herein allows a second deck to commence randomization while a first deck is metering play-ready substacks to the output tray 142.

Figure 30:
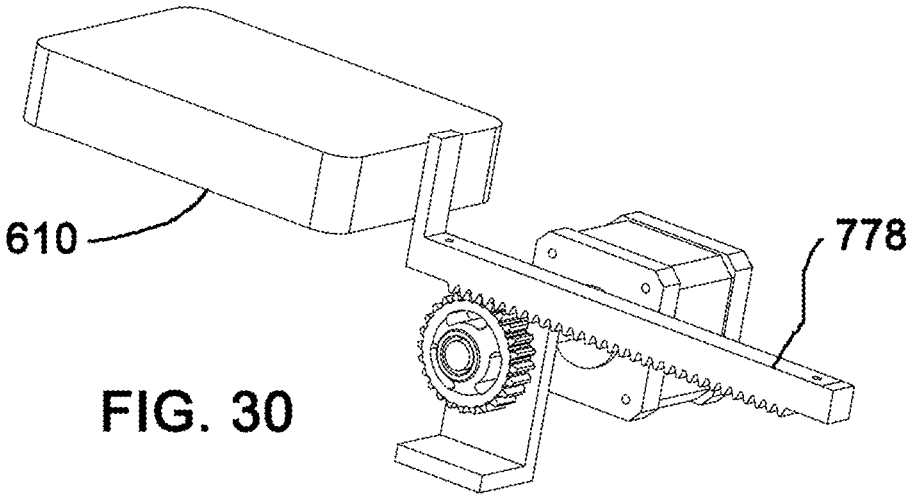
FIG. 30 is alternative device for removing a deck from the elevator using a mechanical arm.
Figure 31:
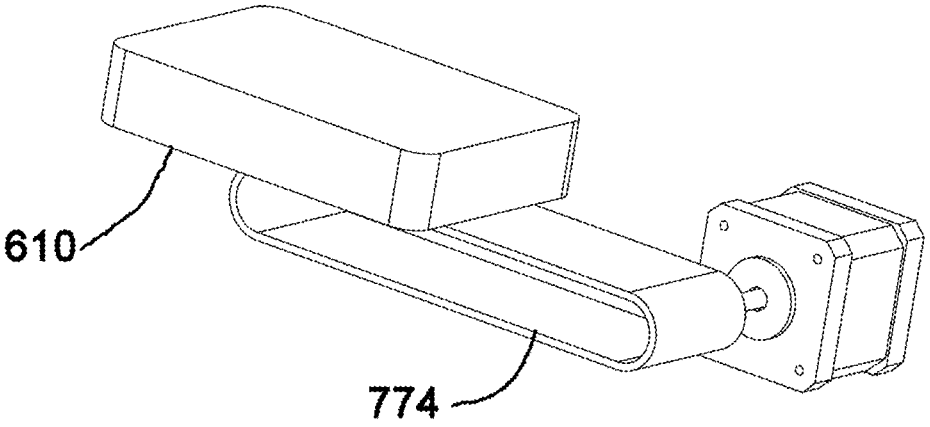
FIG. 31 is an alternative device for removing a deck from the elevator using a belt.

Referring to FIG. 29B, it can be seen that the axis of the metering assembly 140 is sloped so as to permit inertia to propel the verified deck 610 along the axis of the arrow 141 to the curvilinear abutment surface 760 of the metering assembly. Removal of the verified deck 610 from the elevator could also be propelled by a device such a mechanical arm 778 as shown in FIG. 30. Although shown moving linearly, the mechanical arm could rotate or contact a tiltable platform to remove a card deck from the elevator. Alternatively, a moving belt 774 could remove the card deck from the elevator as shown in FIG. 31. These card moving devices are well known in the art.

Figure 32:
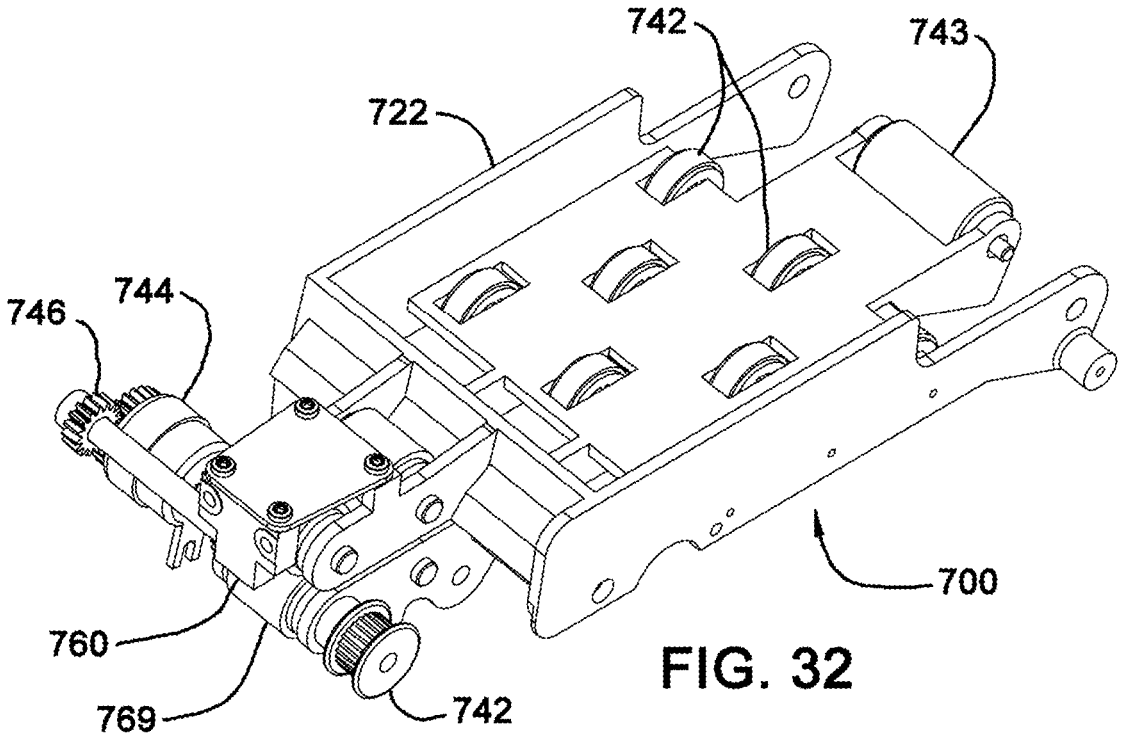
FIG. 32 is an isometric view of the metering station.

An isometric view of the metering station is shown in FIG. 32. The metering station components are mounted to an injection-molded frame 722 which supports the freely rotatable transfer roll 743, a series of freely rotatable rolls 742 and a metering feed mechanism that includes an electromagnetic clutch 746. A section view of the metering station is shown in FIG. 33.

Figure 33:
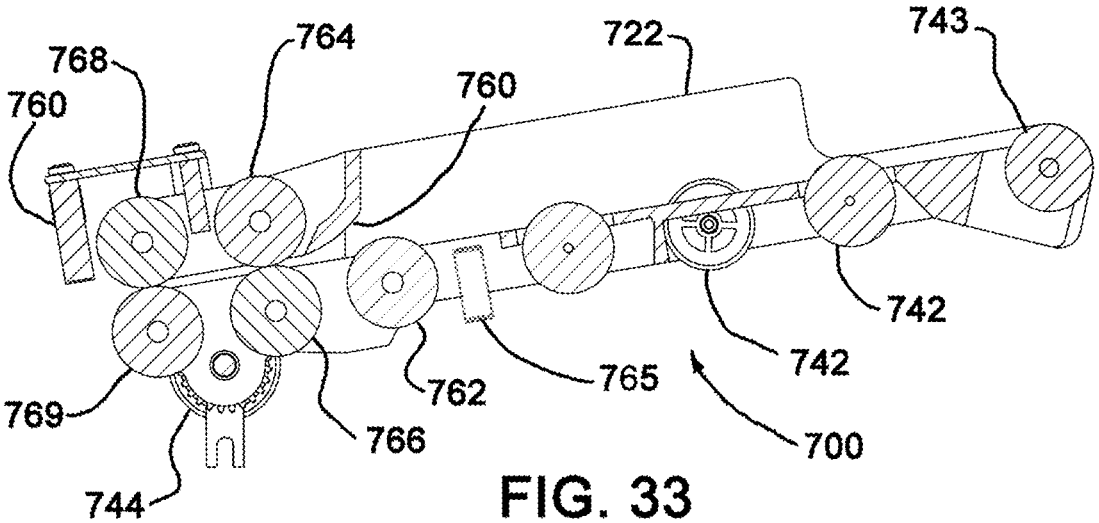
FIG. 33 is a section view of the metering station when isolated from the card handling device.

Referring to FIG. 33, shuffled card stacks move by inertia from the transfer roll 743 along rolls 742 until the leading edge of the deck contacts circular abutment surface 760 as shown in FIG. 18D. Sensor 765 is used to signal the microcontroller when the metering station is empty and therefore capable of receiving a card deck. Once abutted against the surface 760, cards can be metered one by one from the stack to the output tray 142 by metering rolls 762, 766, 764, 768 and 769. Metering rolls 768 and 769 are rotated at a constant speed by a motor which drives motor pulley 742. Metering rolls 766, 764 and 762 are driven independently by an electromagnetic clutch which is actuated intermittently. The clutch-driven rolls move the bottom most card from the stack through the nip between roll 764 and roll 766 until the leading edge is engaged by the nip between constantly rotating rolls 768 and 769. The electromagnetic clutch is thereafter deenergized which allows rolls 764, 766 and 762 to freely rotate while the card is pulled from the stack by rolls 768 and 769. A sensor 760 detects the trailing edge of each card and triggers the clutch to again energize, causing the next card to move from the stack. The sensor 760 additionally counts the cards as they are metered to the output tray 142 allowing the microcontroller to terminate the flow of cards when the proper number of cards has been metered as is required for the player's hand.

The electromagnetic clutch is desirable from the viewpoint of manufacturing cost, but a stepper motor could also be used for the intermittent metering function. The electromagnetic clutch has only one coil and requires only one transistor to actuate, whereas a stepper motor is more expensive, having multiple coils and requiring sophisticated circuitry for its control.

The "high speed" description of the card handling device herein derives its origin from the immediate response and relatively high speed that the cards are metered to the output tray upon command. A prototype of the device described herein meters the cards at a rate of slightly more than three cards per second. For a perspective of metering speed, consider the required discharge of hands consisting of 5 cards for a poker game of 5-card stud. The first hand and each successive hand can be discharged within less than two seconds. This response is probably faster than the dealer can distribute the hands to each of the players.

Figure 34:
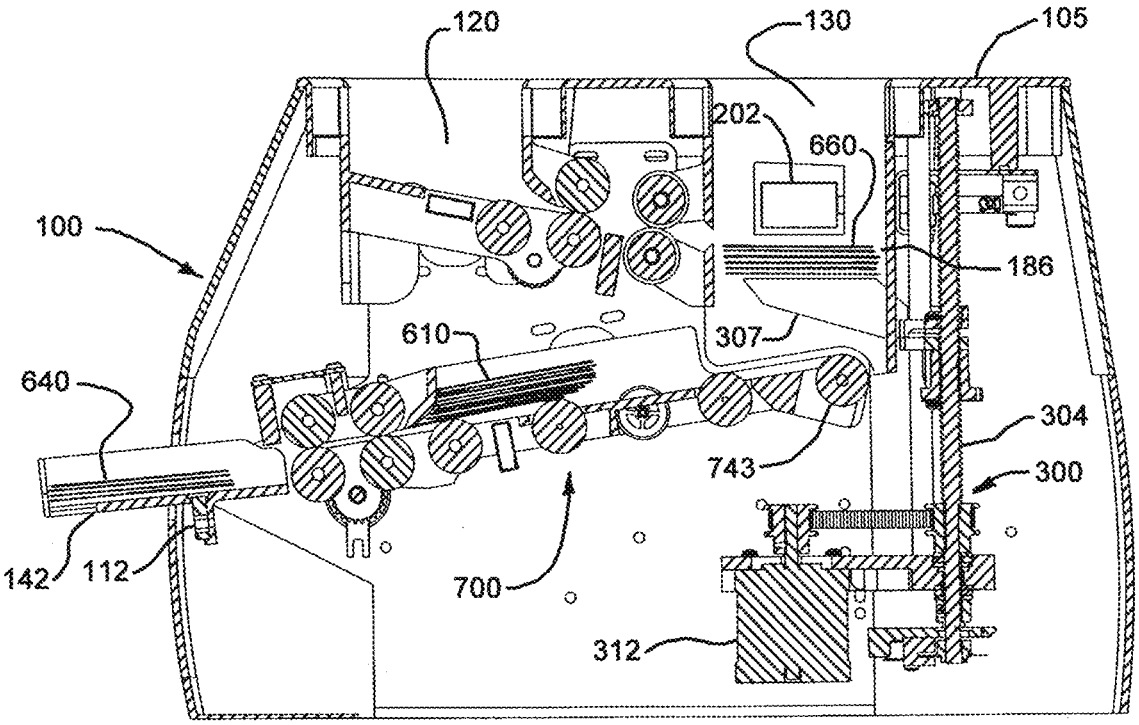
FIG. 34 is a section view of the card handling device showing cards being metered to the output tray while a verified deck is staged at a buffer position.

A significant advantage of the card handling device is that one deck or two decks may be queued at the beginning of a dealer's shift before any game or number of players is resolved. FIG. 34 illustrates the condition whereupon a first deck 610 is being metered to the output tray 142 while a second deck 660 has been successfully shuffled and verified. The second deck 660 is temporarily staged in a buffer position.

The first shuffled deck may be queued at the metering station 700 such that it is immediately available for discharge without needing to resolve the game type or number of players. Once the dealer enters those two parameters and enters a "START" command, the first play-ready hand can be discharged within a few seconds. In the 5-card stud example above, the first play-ready substack can be discharged within less than two seconds after the game start command.

The response is quite advantageous in comparison to hand-forming shufflers that utilize compartments, whereupon the two parameters, game type and number of players, must be resolved before the shuffling operation can commence. Moreover, detection of a faulty deck in a compartment shuffler requires the game to be aborted while the shuffler compartments are unloaded. In comparison, the card handling device herein can shuffle a second deck while a first deck is being metered to the output tray, thus preparing a verified deck for the subsequent game.

After the hands have been distributed to all players, there are cards remaining in the metering assembly. For example, for certain 7-card stud games such as "Rollover" or "Baseball", each hand consists of seven cards which are delivered to each player, and no additional cards are needed for that game. If there are five players, then thirty-five (35) cards will have been metered, leaving seventeen (17) cards within the metering assembly. Comparatively, a game of Three-Card Poker® with five players will only utilize eighteen (18) cards (five player hands and one dealer hand). In this latter case, the majority of cards will remain unplayed and the host operator will purge the shuffler of these residual cards before starting a new game.

The purging cycle of the card handling device herein is relatively fast as compared to the purging cycle in compartment shufflers where there are residual cards remaining in several of the compartments after the hands have all been delivered to the players. All of those compartments need to be shuttled one by one to align with their "pusher mechanisms" in order to discharge the residual cards. Conversely, the metering station in the device herein is purged by rapidly propelling the remaining cards into the discharge tray without requiring multiple pusher strokes or carousel excursions. In the above example of 17 cards remaining in the metering station, the device herein can purge them in about 6 seconds.

An alternate embodiment of the card handling device herein eliminates the faulty deck discharge portal 130. In this embodiment. All decks are discharged through the metering station 700, including faulty decks, and the advantages of processing two decks simultaneously is retained in this embodiment.

Figure 35:
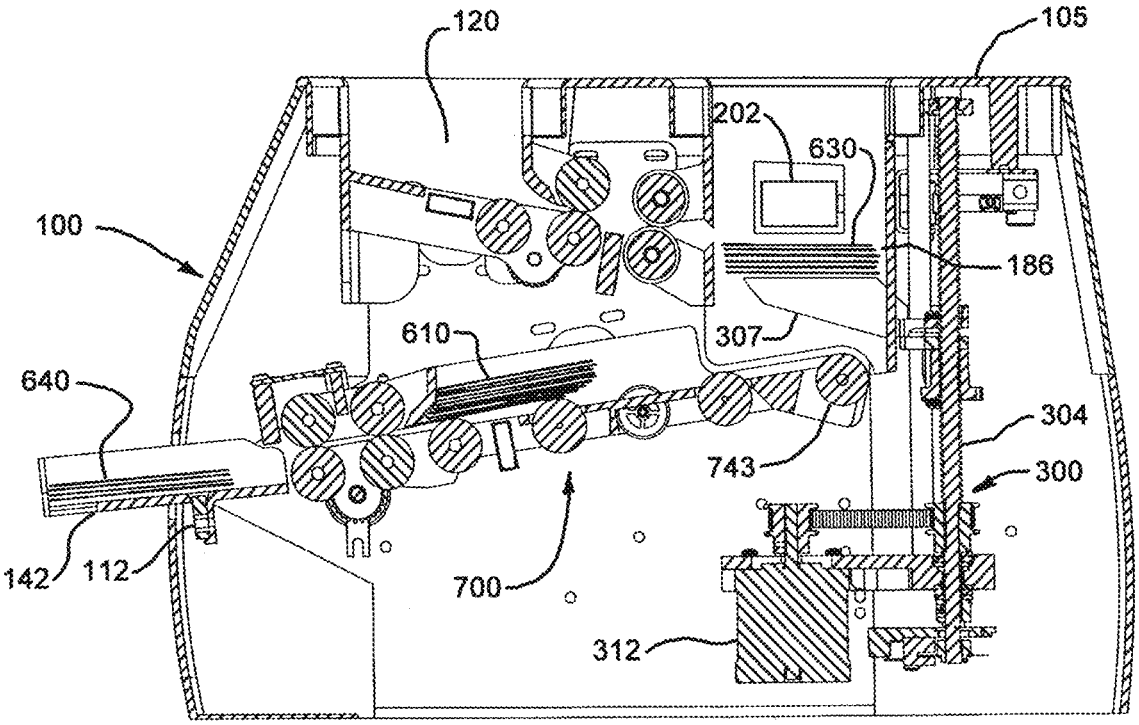
FIG. 35 is a section view of the card handling device showing cards being metered to the output tray while a faulty deck is staged at a buffer position.

FIG. 35 illustrates the condition where verified substacks 640 from a first verified deck 610 are being metered to the output tray 142. A second deck 630 is staged upon the elevator arms after having been shuffled and identified as faulty. In this case, the touch screen alerts the dealer to the faulty deck and will warn the dealer to purge that deck after the current game has been completed. In the examples provided herein, a full deck can be purged through the metering station in about 17 seconds.

One of ordinary skill, having designer's choice, may choose to utilize different forms of actuators and transport components as described herein. Other forms of transport components, including cables, gears, chains and other types of belts may be substituted for those described herein. Other types of motors and solenoids are also logical substitutions. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handing device for metering play-ready hands of playing cards from a verified card deck directly into an output tray, the card handing device comprising:

a housing;

a control panel positioned on the exterior of the housing for programming a game type and a number of players;

an input portal consisting of a single card receiving cavity for receiving unshuffled cards;

a first card discharge portal consisting of a card output tray for receiving play-ready substacks;

a second card discharge portal consisting of a chamber for receiving faulty card decks;

at least one verification sensor for detecting card deck integrity;

at least one microcontroller responsive to the control panel and to the at least one verification sensor for controlling movement of the cards;

one slot-less elevator aligned with an axis of a randomizing chamber and movable along the axis within the randomizing chamber;

a gripper mechanism located in the randomizing chamber;

the microcontroller able to discern a fault condition in a first or a second shuffled card deck;

a metering station for moving shuffled cards from a first verified deck to the card output tray one card at a time;

the slot-less elevator configured to relocate a first shuffled card deck to either the second discharge portal or the metering station, dependent upon a fault criteria determination of the microcontroller;

whereupon the metering station moves play-ready substacks from the first verified card deck to the output tray automatically upon removal of the previous substack;

whereupon the second deck can be undergoing shuffling within the randomizing chamber simultaneously while the first deck is being metered to the output tray;

whereupon the second deck can be temporarily stored on the slot-less elevator at a buffer position simultaneously while the first deck is being metered to the output tray;

wherein the second deck is a verified deck; and whereupon the first verified deck may be queued at the metering station before the number of players or type of game is resolved.

2. The card handling device of claim 1 whereupon the first verified deck is removed from the slot-less elevator by centrifugal force.

3. The card handling device of claim 1 whereupon the first verified deck is moved to the metering station by inertia.

4. The card handling device of claim 1 further comprising a non-motorized transfer roll for removing verified card decks from the slot-less elevator.

5. The card handling device of claim 1 further comprising a motorized transfer roll for removing verified card decks from the slot-less elevator.

6. The card handling device of claim 1 further comprising a motorized belt for removing card decks from the slot-less elevator.

7. The card handling device of claim 1 further comprising a mechanical arm for removing card decks from the slot-less elevator.

8. The metering station of claim 1 whereupon cards are metered by an electromagnetic clutch.

9. The metering station of claim 1 whereupon cards are metered by a motor.

10. A card handing device for metering play-ready hands of playing cards from a verified card deck directly into a card output tray, the card handing device comprising:

a housing;

a control panel positioned on the exterior of the housing for programming a game type and a number of players;

an input portal consisting of a single card receiving cavity for receiving unshuffled cards;

a card discharge portal consisting of a card output tray for receiving play-ready substacks;

at least one verification sensor for detecting card deck integrity;

at least one microcontroller responsive to the control panel and to the at least one verification sensor for controlling movement of the cards;

one slot-less elevator aligned with an axis of a randomizing chamber and movable along the axis within the randomizing chamber;

a gripper mechanism located in the randomizing chamber;

the microcontroller able to discern a fault condition in a first or a second shuffled card deck;

a metering station for moving cards from a card deck to the card output tray one card at a time;

whereupon the metering station moves play-ready substacks from the verified card deck to the card output tray automatically upon removal of the previous substack;

whereupon the second deck can be undergoing shuffling within the randomizing chamber simultaneously while the first deck is being metered to the output tray;

whereupon the second deck can be temporarily stored on the slot-less elevator at a buffer position simultaneously while the first deck is being metered to the output tray;

wherein the second deck is either the verified deck or a faulty deck; and whereupon the first deck may be queued at the metering station before the number of players or type of game is resolved.

11. The card handling device of claim 10 whereupon a card deck is removed from the slot-less elevator by centrifugal force.

12. The card handling device of claim 10 whereupon a card deck is moved to the metering station by inertia.

13. The card handling device of claim 10 further comprising a non-motorized transfer roll for removing a card deck from the slot-less elevator.

14. The card handling device of claim 10 further comprising a motorized transfer roll for removing a card deck from the slot-less elevator.

15. The card handling device of claim 10 further comprising a motorized belt for removing a card deck from the slot-less elevator.

16. The card handling device of claim 10 further comprising a mechanical arm for removing a card deck from the slot-less elevator.

17. The metering station of claim 10 whereupon cards are metered by an electromagnetic clutch.

18. The metering station of claim 10 whereupon cards are metered by a motor.

19. The card handling device of claim 10 whereupon the faulty deck may be moved to the metering station and thereafter discharged to the output tray after completion of the game that has utilized the first deck.

* * * * *